US005951027A

United States Patent [19]

Oyen et al.

[11] Patent Number: 5,951,027

[45] Date of Patent: Sep. 14, 1999

[54] SHOCK ABSORBENT IN-LINE ROLLER SKATE WITH WHEEL BRAKES-LOCK

[76] Inventors: Gerald O. S. Oyen, #480 - 601 West Cordova Street, Vancouver, British Columbia, Canada, V6B 1G1; Francois Eugene Charron, P.O. Box 169, Suite 101 - 1184 Denman Street, Vancouver, British Columbia, Canada, V6G 2M9

[21] Appl. No.: 08/746,418

[22] Filed: Nov. 12, 1996

Related U.S. Application Data

[63] Continuation-in-part of application No. 08/261,037, Jun. 14, 1994, Pat. No. 5,575,489, which is a continuation-in-part of application No. 08/050,819, Apr. 22, 1993, Pat. No. 5,330, 208.

[51] Int. Cl.[6] ..... A63C 17/04

[52] U.S. Cl. ..... 280/11.22; 280/11.2; 280/11.27; 280/11.28

[58] Field of Search ..... 280/11.2, 11.22, 280/11.23, 11.27, 11.28, 11.19, 87.042

[56] References Cited

U.S. PATENT DOCUMENTS

| | | | |
|---|---|---|---|
| 1,609,612 | 12/1926 | Eskeland | 280/11.28 |
| 1,616,952 | 2/1927 | Dahl . | |
| 2,644,692 | 7/1953 | Kahlert . | |
| 3,880,441 | 4/1975 | Silver . | |
| 4,666,168 | 5/1987 | Hamill et al. . | |
| 4,909,523 | 3/1990 | Olson . | |
| 4,915,399 | 4/1990 | Marandel . | |
| 5,092,614 | 3/1992 | Malewicz . | |
| 5,183,292 | 2/1993 | Ragin, III . | |
| 5,190,301 | 3/1993 | Malewicz . | |
| 5,192,099 | 3/1993 | Riutta . | |
| 5,236,224 | 8/1993 | Anderson et al. . | |
| 5,303,955 | 4/1994 | Zurnamer . | |
| 5,398,949 | 3/1995 | Tarng | 280/11.28 |
| 5,445,415 | 8/1995 | Campbell . | |
| 5,472,218 | 12/1995 | Pratt | 280/11.22 |
| 5,503,433 | 4/1996 | Lachapelle . | |
| 5,522,621 | 6/1996 | Schneider . | |

*Primary Examiner*—Richard M. Camby
*Attorney, Agent, or Firm*—Oyen Wiggs Green & Mutala

[57] ABSTRACT

An in-line roller skate comprising: (a) a boot with a heel and toe adapted to receive a foot of a skater; (b) a first wheel supporting rail secured to an underside of the boot and extending from the heel to the toe, the first rail having an opening therein between the heel and the toe to thereby form upper and lower first rail regions; (c) a second wheel supporting rail secured to an underside of the boot, and extending from the heel to the toe adjacent and generally parallel to the first rail, the second rail having an opening therein between the heel and the toe to thereby form upper and lower rail regions; (d) a plurality of wheels mounted in tandem in a line between the first and second rail, the wheels being respectively connected to the lower regions of the first and second rail by respective axles; and (e) at least one first resilient shock absorbing member located between the upper and lower regions of the first rail; (f) at least one second resilient shock absorbing member located between the upper and lower regions of the second rail, the first and second shock absorbing members enabling the respective wheels to move under force individually or in combination upwardly or downwardly relative to the upper regions of the first and second rails and the boot.

31 Claims, 18 Drawing Sheets

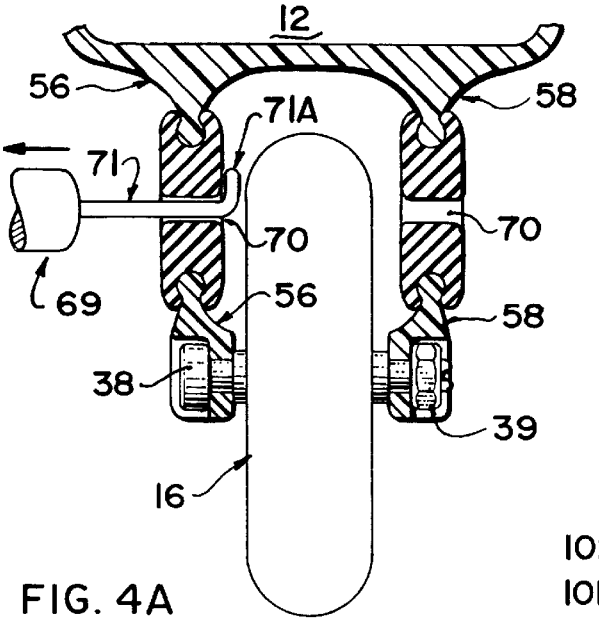
FIG. 4A
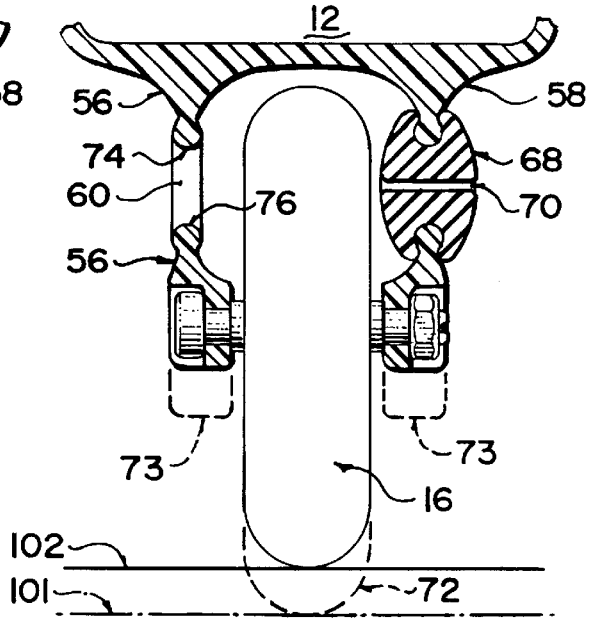
FIG. 4B
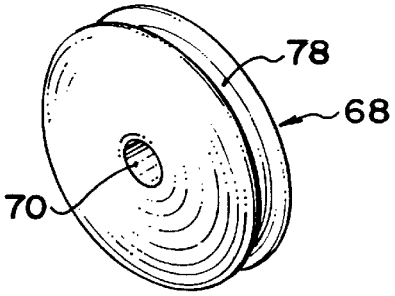
FIG. 4F
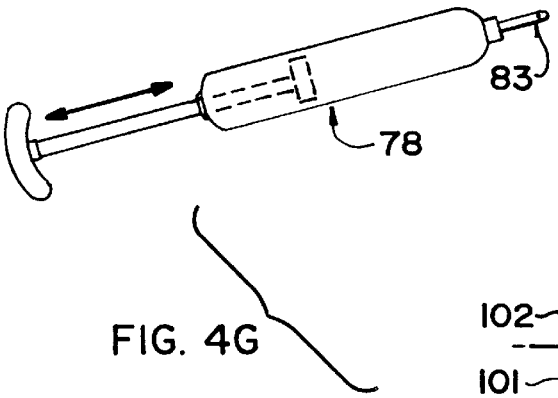
FIG. 4G
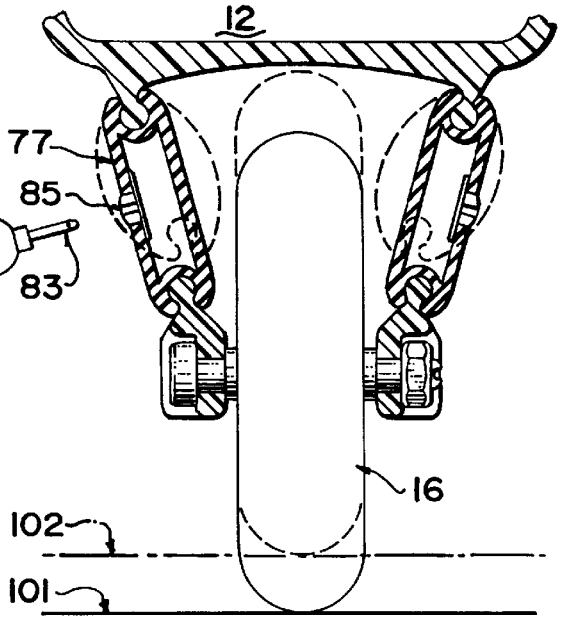

SHOCK ABSORBENT IN-LINE ROLLER SKATE WITH WHEEL BRAKES-LOCK

This application is a continuation-in-part of application Ser. No. 08/261,037, filed Jun. 14, 1994, now allowed U.S. Pat. No. 5,575,487, which was a continuation-in-part of application Ser. No. 08/050,819, filed Apr. 22, 1993, which is now U.S. Pat. No. 5,330,208, granted Jul. 19, 1994.

FIELD OF THE INVENTION

This invention is directed to in-line roller skates. More particularly, this invention pertains to in-line roller skates wherein the wheels can be braked or locked by wheel stop members, and the wheels are resiliently mounted to absorb shock and navigate over rough, bumpy surfaces.

BACKGROUND OR THE INVENTION

In-line roller skates have become very popular with the public in the past few years. However, the in-line roller skates that are available on the market have a number of inherent limitations. For one thing, the wheels and axles are rigidly mounted to the frame member under the boot and there is minimal shock absorbing capacity built into the wheels. Accordingly, it is difficult for a person wearing conventional in-line roller skates to skate over uneven or bumpy surfaces. Transmission of excessive high frequency low amplitude vibration due to road surface irregularities may blister a skaters foot as well as cause fatigue. Impacts of high amplitude at any frequency may cause a loss of balance and a serious fall.

Existing in-line skates offer limited shock absorption through the use of a slightly soft tire compound which compensates for only minor bumps. Such tires require frequent replacement due to wear and tear. Use of a relatively soft tire compound, while lending more shock absorbing capacity, increases rolling friction and detrimental heat buildup. This may soften the tire, degrade bearings and overall, require greater skating effort, particularly in high ambient temperatures.

Existing in-line skates usually have three to five tandem wheels in relatively rigid horizontal and vertical alignment. In a three wheel skate, when a skater encounters a bump, in forward motion, the initial upward wheel impact forces the toe upward. Impact with the following middle wheel raises the toe still further leaving ground contact substantially with the final wheel. This action tends to destabilize the skater by removing toe contact which normally supplies the best control.

Allowing independent wheel deflection vertically while maintaining lateral rigidity would enable greater control and stability over relatively rough terrain. Transferring the resilient action away from the tire also would allow the use of harder tire compounds which would reduce friction and provide reduced skating effort.

Another problem is braking. Most in-line skates have a rear brake pad on one skate. It would be helpful if a wheel rotation braking and/or stopping mechanism could be used. This would avoid unwanted wheel rotation when the skater is ascending or descending hills, stairs, and the like, or enable the skater to slow wheel rotation when desired.

U.S. Pat. No. 4,915,399, Marandel, granted Apr. 10, 1990 discloses a front and rear wheel roller skate design which has a suspension system on the front and rear wheels. The roller skate is equipped at the level of the front and rear pivoting axles, with a suspension system for damping shocks resulting from unevenness of a skating surface. The front and rear pivoting axles are each provided with a suspension system which is fixed at one end on the central part of the pivoting axle, and at the other end being guided by a centring barrel located inside a base of the skate. The pivoting axles are also each equipped with a pivoting system secured at one end to the base by a pivoting device while the other end is secured to an arm of the central part by resilient washers. Marandel does not disclose in-line roller skates. He discloses conventional roller skates with a pair of wheels on a front axle and a pair of wheels on a rear axle.

U.S. Pat. No. 5,092,614, Malewicz, assigned to Rollerblade, Inc., granted Mar. 3, 1992, discloses a lightweight in-line roller skate frame and frame mounting system. The in-line roller skate has a frame including a pair of side rails, each side rail having front and rear mounting brackets for attachment of the frame to the boot of the in-line roller skate. Each frame side rail includes a curved portion and a planar portion. The planar portion carries a plurality of axle apertures through which an axle for a wheel may be inserted. Preferably, the axle apertures are configured to receive an axle aperture plug, have an eccentrically disposed axle bore and are situated on the frame side rails such that the wheels may be mounted at multiple relative heights to each other. Malewicz does not disclose any shock absorbing mechanism for the in-line wheels, or any ability for the wheels to move upwardly or downwardly in order to recede when the wheels impact a bump or obstruction.

U.S. Pat. No. 5,192,099, granted Mar. 9, 1993, Riutta, discloses a roller skate brake in which the wheel support which rotatably couples the skate's wheels to the boot is slotted, thereby allowing the support to flex when the skater bears down with the heel. Such flexing compresses the support, forcing a brake shoe against the skate's rear wheel. The braking force varies in proportion to the applied force, and is released when the skater stops bearing down. A roller skate starter aids initial propulsion of a roller skate's wheels. The starter incorporates a restraining mechanism which prevents reverse rotation of the skate's toe wheel, while allowing forward rotation thereof. It is not possible to skate backwards.

U.S. Pat. No. 5,398,949, granted Mar. 21, 1995, Tarng, discloses an in-line roller skate which has a steering cushion mechanism comprising mounting the wheels of the skates with individual coil springs. Due to the steering cushion mechanism, and the individual coil spring action, as the roller blade skate tilts, the bottoms of the wheels are able to move laterally so that they are aligned on a curved track. By shifting the body weight to the right, the steering cushion mechanism causes the wheels to curve to the right. By shifting the body weight to the left, the steering cushion mechanism causes the wheels to curve to the left. The brake wheel uses a clamping force to brake the skate to stop. The brake wheel can serve as both wheel and brake. The axles are not rigidly attached to the wheel frame or side rails. There is no resilient shock absorbing action to the wheel frame. Numerous small parts are required to construct the skate.

U.S. Pat. No. 4,666,168, granted May 19, 1987, discloses a two-wheel roller skate. The skate preferably includes a bifurcated truck assembly that is interlockingly and removably attached to a sole plate, as well as a quick-change wheel and axle apparatus. At least in a two-wheeled version of the roller skate apparatus, the wheels preferably include a generally flat horizontal central portion on the ground-engaging wheel periphery in order to provide greater ease and stability in two-wheeled skating. Various adjustable and quick-change toe stop embodiments are also enclosed.

A series of U.S. patents listed as follows disclose various removable devices for locking one or more of the wheels of in-line skates:

| U.S. Pat. No. | Inventor | Date |
|---|---|---|
| 5,183,292 | Ragin | February 2, 1993 |
| 5,236,224 | Anderson et al. | August 17, 1993 |
| 5,303,955 | Zurnammer | August 19, 1994 |
| 5,445,415 | Campbell | August 29, 1995 |
| 5,503,433 | Lachapelle | April 2, 1996 |
| 5,522,621 | Schneider | June 4, 1996 |

None of these patents disclose wheel locking devices that are built into the skate.

SUMMARY OF THE INVENTION

The invention is directed to an in-line roller skate comprising: (a) a boot with a heel and toe adapted to receive a foot of a skater; (b) a first wheel supporting rail means secured to an underside of the boot and extending from the heel to the toe, the first rail means having an opening therein between the heel and the toe to thereby form upper and lower first rail regions; (c) a second wheel supporting rail means secured to an underside of the boot, and extending from the heel to the toe proximate and generally parallel to the first rail means, and spaced from the first rail means, the second rail means having an opening therein between the heel and the toe to thereby form upper and lower rail regions; (d) a plurality of wheel means mounted in tandem in a line between the first and second rail means, the wheel means being respectively connected to the lower rail regions of the first and second rail means by a respective series of lateral axle means and bearing means; (e) at least one first resilient shock absorbing means located in the opening, or proximate to the opening between the upper and lower regions of the first rail means; (f) at least one second resilient shock absorbing means located in the opening or proximate to the opening between the upper and lower regions of the second rail means, the first and second resilient shock absorbing means enabling the plurality of wheel means to move under force individually or in combination upwardly or downwardly relative to the upper regions of the first and second rail means and the boot.

There can be a pair of respective resilient shock absorbing means for each wheel, axle and bearing means and the resilient shock absorbing means can be mounted in respective cavities formed in the first and second rail means.

The lower regions of the first and second wheel supporting rail means can have lateral stabilizer webs extending between them and the respective resilient shock absorbing means can be replaceable resilient members located proximate to the openings in the first and second rail means and can enable the wheel means and the lower regions of the first and second rail means to move upwardly when subjected to a force.

The roller skate can have four wheels and at least four openings can be formed in the first rail means and at least four openings can be formed in the second rail means, the openings coinciding generally with the positions of the four wheels respectively, and each opening being adapted to receive respective removable resilient shock absorbing means.

The resilient shock absorbing means can be resilient elastomeric plugs that can be held in place in relation to the axle means and the rail means by connector means. The first and second resilient shock absorbing means can be coil springs.

The invention is also directed to an in-line roller skate comprising: (a) a boot adapted to receive a foot of a skater; (b) a wheel mounting means secured to the underside of the boot, longitudinal with the boot, and having therein an elongated longitudinal wheel receiving cavity which defines a first longitudinal side rail and a second longitudinal side rail parallel with and spaced from the first side rail with at least one first opening formed in the first side rail, and at least one second opening formed in the second side rail of the wheel mounting means; (c) a plurality of wheels rotatably mounted in series within the wheel receiving cavity; (d) a first removable resilient compression force absorbing means fitted in or proximate to the first opening in the wheel mounting means; (e) a second removable resilient compression force absorbing means fitted in or proximate to the second opening of the wheel mounting means, thereby enabling the wheels to deflect into the interior of the wheel receiving cavity when subjected to a force.

The first resilient compression force absorbing means can comprise a plurality of first resilient compression force absorbing means, and the second resilient compression force absorbing means can comprise a plurality of second resilient compression force absorbing means, which in combination can enable the wheels to deflect into the interior of the wheel receiving cavity. The resilient compression receiving means can be formed of resilient elastomer.

The first and second rails of the wheel mounting means can have formed therein at least one respective opening, each opening receiving at least one resilient disc-like compression absorbing means. The disc-like compression absorbing means can be connected together in pairs. The first and second resilient compression force absorbing means can be coil springs.

The wheels can have rotatable bearings therein and can be mounted on axles which are secured to the first and second side rails of the wheel supporting means, below the first and second openings.

First and second resilient compression absorbing means can be coil springs which can be detachably fitted above the axles of the wheels which can be rotatably mounted in the wheel mounting means.

The roller skate can include a releasable wheel stop located between the underside of a toe of the boot and the top of a front wheel of the plurality of wheels, said wheel stop being capable of being reciprocally moved from a forward extended non-wheel locking position, to a rearward recessed wheel locking position. The wheel stop can include releasable detente means which holds the wheel stop in a predetermined position.

The invention also pertains to an in-line roller skate comprising: (a) a boot adapted to receive a foot of a skater; (b) a wheel mounting means secured to the underside of the boot, longitudinal with the boot, and having an elongated longitudinal wheel receiving cavity therein, to form on either side first and second rail means; (c) a plurality of wheels rotatably mounted on axles and bearings in series within the wheel receiving cavity in longitudinal alignment with one another; (d) a plurality of resilient shock absorbing means located between the respective axle means and bearing means and the first and second rail means to enable the respective wheel means to move under force upwardly or downwardly relative to the first and second rail means; and (e) a releasable wheel rotation stop means located between the underside of the boot and a wheel of the plurality of wheels, said wheel rotation stop means being moveable so that it can impinge against the wheel to retard rotation of the wheel.

The wheel stop means can be moveable between a first position wherein the stop means is free of the forward wheel and permits the forward wheel to rotate and a second position wherein the stop means abuts the forward wheel and prevents rotation of the forward wheel. The wheel stop means can have releasable lock means which can enable the stop means to be locked in a first or second position.

The roller skate can include a second wheel stop means which can be located between the underside of a heel of the boot and above a rear wheel of the plurality of wheels. The wheel rotation stop means can be slidably mounted on the underside of the toe, the stop means can have a curved friction surface which faces the adjacent wheel means, and the stop means can be movable horizontally between a first extended position whereby the curved surface of the wheel rotation stop means does not impinge on a front wheel, and a second recessed position whereby the curved surface of the wheel rotation stop means impinges on the front wheel and thereby stops rotation of the front wheel.

The wheel rotation stop means can slidably move in respective slots in the first and second rail means and the stop means can have lateral projections on each side thereof, the projections releasably fitting in respective detente openings formed in the first and second rails of the wheel mounting means, thereby enabling the wheel stop means to reciprocally move from a first extended position to a second recessed position.

The wheel rotation stop means can have a releasable lock means which can enable the stop means to be releasably locked in a first wheel-free position or releasably locked in a second wheel lock position whereby the wheel is prevented from rotating.

The plurality of wheels can be mounted in tandem in a line between the first and second rail means and can have therein a plurality of resilient spokes which enable the circumferences of the respective wheels to depress relative to the axle means when subjected to a load, and thereby absorb shock.

The invention is directed to an in-line roller skate comprising: (a) a boot with a heel and toe adapted to receive a foot of a skater; (b) a first wheel supporting rail means secured to an underside of the boot and extending from the heel to the toe; (c) a second wheel supporting rail means secured to an underside of the boot, and extending from the heel to the toe adjacent and generally parallel to the first rail means; (d) a plurality of wheel means mounted in tandem in a line between the first and second rail means, the wheel means being respectively connected to the first and second rail means by respective axle means and bearing means; and wherein the wheels have therein a plurality of resilient spokes which enable the circumferences of the respective wheels to depress relative to the axle means when subjected to a load, and thereby absorb shock.

The invention is also directed to a detachable wheel rotation brake for an in-line roller skate having a boot with toe and heel, a sole and a plurality of wheels rotationally oriented in a line within a wheel carriage connected to the sole, said brake comprising: (a) a brake member which is adapted to be releasably secured between the toe and a forward wheel, or between the heel and a rearward wheel; (b) a friction face on a first side of the brake member adapted to bear against at least one wheel of the skate; (c) a bearing face on a second side of the brake member adapted to detachably connect directly or indirectly to the sole of the boot; (d) a movement member which enables the brake member to move reciprocally from a first position whereby the friction face is clear of a wheel of the skate, and a second position whereby the friction face abuts a wheel of the skate; (e) a releasable retaining member which retains the brake member in the first position of the second position; and (f) a releasable securing member which enables the brake member to be detachably engaged with the sole of the boot.

The releasable retaining member of the brake can have at least one protrusion on the lateral side thereof, said protrusion slideably moving in a horizontal slot on each lateral side of the wheel carriage. The releasable retaining member can have a releasable lock means which enables the stop means to be releasably locked in an extended wheel-free position or releasably locked in a second retracted position whereby the proximate wheel is prevented from rotating.

The brake can include a resilient member which urges the brake from a second position to a first position. It can include a lever member which can be tripped to release the brake from a second position to the first position.

The releasable lock means can comprise a plurality of depressions and projections on the brake which correspond with a plurality of projection and ridges on the releasable movement member.

BRIEF DESCRIPTION OF THE DRAWINGS

In the drawings which represent specific embodiments of the invention but which should not be regarded as restricting the spirit or scope of the invention in any way:

FIG. 4A illustrates a section view taken along section line 4A—4A of FIG. 4.

FIG. 4B illustrates a variation of a section view taken along section line 4A—4A of FIG. 4 when the roller wheel is reacting to upward compression, and a disc removed for clarity.

FIG. 4F which appears on the same sheet as FIGS. 4A and 4B, illustrates an isometric view of a resilient shock absorbent spring plug.

FIG. 4G which appears on the same sheet as FIGS. 4A and 4B, illustrates an end partial section view of a sixth embodiment of the invention with air-filled resilient discs.

DETAILED DESCRIPTION OF SPECIFIC EMBODIMENTS OF THE INVENTION

Figure 1:
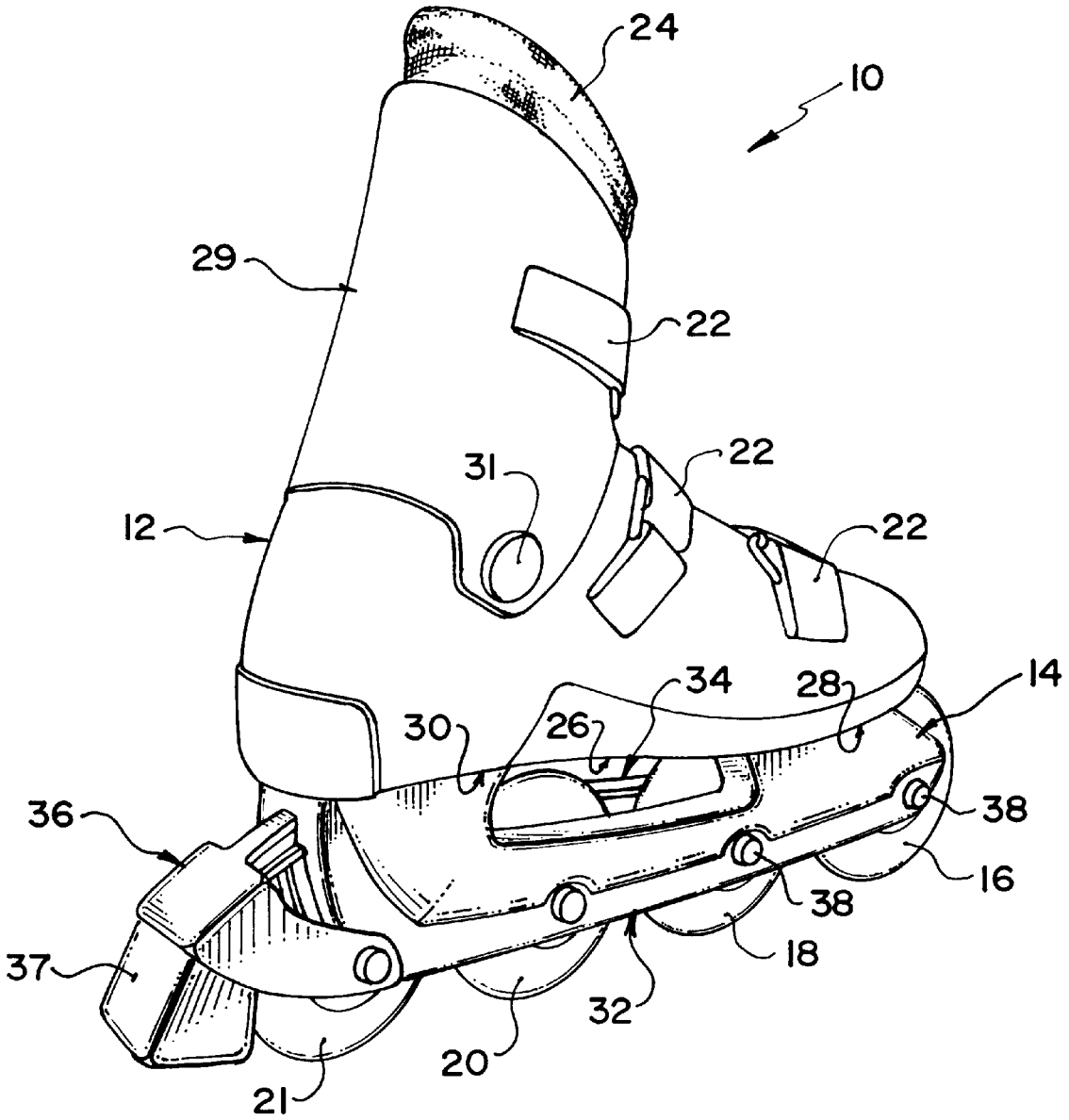
PRIOR ART FIG. 1
FIG. 1 illustrates a perspective view of a conventional prior art in-line roller skate with four in-line wheels and a rail frame securing the wheels to a boot.

FIG. 1 illustrates in perspective view a conventional in-line roller skate 10. The skate 10 includes a boot 12 and a rigid wheel frame 14 attached on the underside thereof. Frame 14 rotatably supports four in-line wheels which are identified from front to rear respectively as wheels 16, 18, 20 and 21. Frame 14 is attached to the under-sole 26 of boot 12 at a front sole attachment 28 and a rear sole attachment 30. Frame 14 includes parallel first and second side rails 32 and 34 respectively. Side rail 34 is partly visible in FIG. 1. The side rails 32 and 34 are used for mounting the axles of the wheels 16, 18, 20 and 21. Frame 14 may include at the rear a brake assembly 36 having a braking pad 37 which a skater may use to assist in stopping forward or reward motion, by pressing the pad against the ground.

Boot 12 includes an ankle cuff 29 which is pivotally attached to boot 12 by a cuff pivot point 31. Boot 12 further includes a plurality of boot closure means 22 for closely conforming the boot 12 to a skater's foot. As shown in FIG. 1, closure means 22 are individual buckle type closures, which are conventional. Other known means of tightening a boot onto a foot, such as laces and eyelets, or hook and pile fastener straps are also feasible and are within the scope of the present invention. Boot 12 may include a soft absorbent liner 24 which may be removable if desired.

Figure 2:
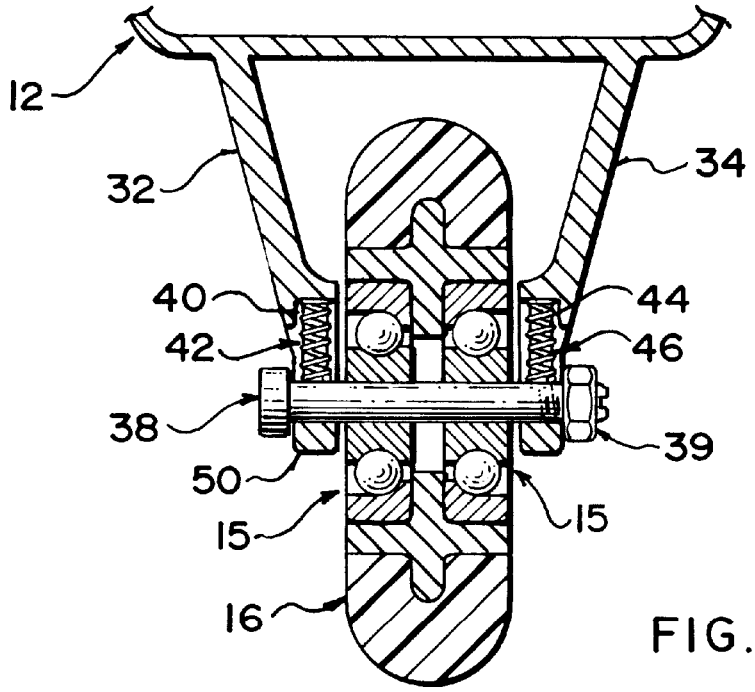
FIG. 2 illustrates a front partial section view of an in-line roller wheel axle, spring-mounted to a wheel carrying frame attaching the wheel and axle to the boot.

FIG. 2 illustrates a front partial section view of a wheel 16, which is rotatable on an axle 38. The axle 38 rotates in a pair of ball bearings 15 in the wheel 16, which is conventional. The bearings 15 reduce friction and minimize heat development when the wheels 16, 18, 20 and 21 (see FIG. 1) rotate while the skater is skating. The axle 38 is held in place by nut 39. The first side rail 32 is constructed to include therein a vertical cavity 40 which can receive a coil spring 42. The top end of the coil spring 42 bears against the top of the cavity 40, which is slightly notched. At its lower end, the spring 42 bears against the top side of axle 38. The wheel 16 rotates by bearings 15 on the axle 38 which is basically stationary. The second side rail 34 is constructed to have therein a similar second spring cavity 44 and a second coil spring 46. This construction with dual springs 42 and 46, one on each side of the wheel 16, enables wheel 16 to move upwardly or downwardly (depending upon the degree of softness of the springs 42 and 46) against the pair of springs 42 and 46 respectively when the wheel 16 contacts an obstruction or bump in the ground surface over which the skate is traversing. The construction also permits a slight amount of lateral tilting of the wheel 16, which can be controlled by the degree of stiffness of the coil springs 42 and 46.

The other three wheels illustrated in FIG. 1, namely, wheels 18, 20 and 21, are similarly equipped with corresponding coil springs and cavities in the side rails 32 and 34 in order to enable those wheels to also yield upwardly against the springs when bumps or obstructions are encountered on the ground surface. The springs 42 and 46, and the other springs, are selected to have sufficient compression force to carry the weight of the skater. The springs can be removed and replaced with springs of other compressive force to proportionately accommodate the weight of lighter or heavier skaters. Spring systems other than coil springs, for instance, resilient rubber blocks, or leaf springs may be used.

Figure 3:
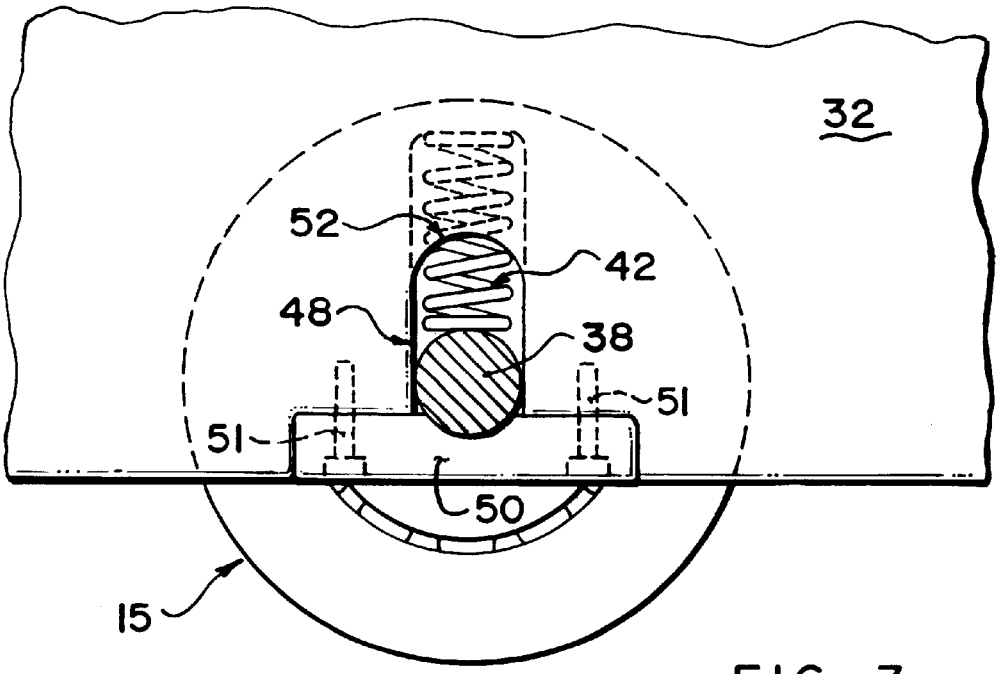
FIG. 3 illustrates a side view of a wheel bearing and axle, spring-mounted to a frame of an in-line roller skate.

FIG. 3 illustrates a detailed side view of the axle 38, wheel bearing 15 and spring construction illustrated in FIG. 2. The wheel or tire 16 is not shown. In FIG. 3, it can be seen that side rail 32 has formed therein a vertical longitudinal axle well 48, in which axle 38 and wheel 16 can move upwardly or downwardly within fixed limits. Forward or rearward movement of the axle and wheel is restricted. The downward movement of axle 38 and wheel bearing 15 are restricted by cross bar 50. Bar 50 is held in place against rail 32 by a pair of counter sunk screws 51. Likewise, the upward movement of axle 38 and bearing is limited by the top 52 of well 48. As seen in FIG. 2, wheel 16, which rotates about axle 38 by means of the ball bearings 15, is free to move upwardly against the downward force exerted by coil spring 42, whenever the bottom of wheel 16 hits an obstruction in the ground surface over which the skater is skating. The distance of axle travel between bar 50 and the top 52 of well 48 is sufficient to enable the spring 42 to absorb the shock caused by most bumps encountered by the skater. While spring 42 is visible in FIG. 3, as depicted, side rail 32 can be designed and formed (such as by injection molding) to provide a cover for spring 42, and well 48, so that they are not visible. This may be desirable for cosmetic or design reasons or to retard inclusion of foreign particles.

As used in this disclosure the term "resilient material" means a material or device which is elastic, deforms, recoils, rebounds and resumes original shape and size after being stretched or compressed under a force, which is subsequently removed. The resilient material can include resilient discs, elastomer plugs, coil springs, leaf springs and other types of shock absorbing devices which are adaptable to an in-line roller skate.

Figures 4, 18:
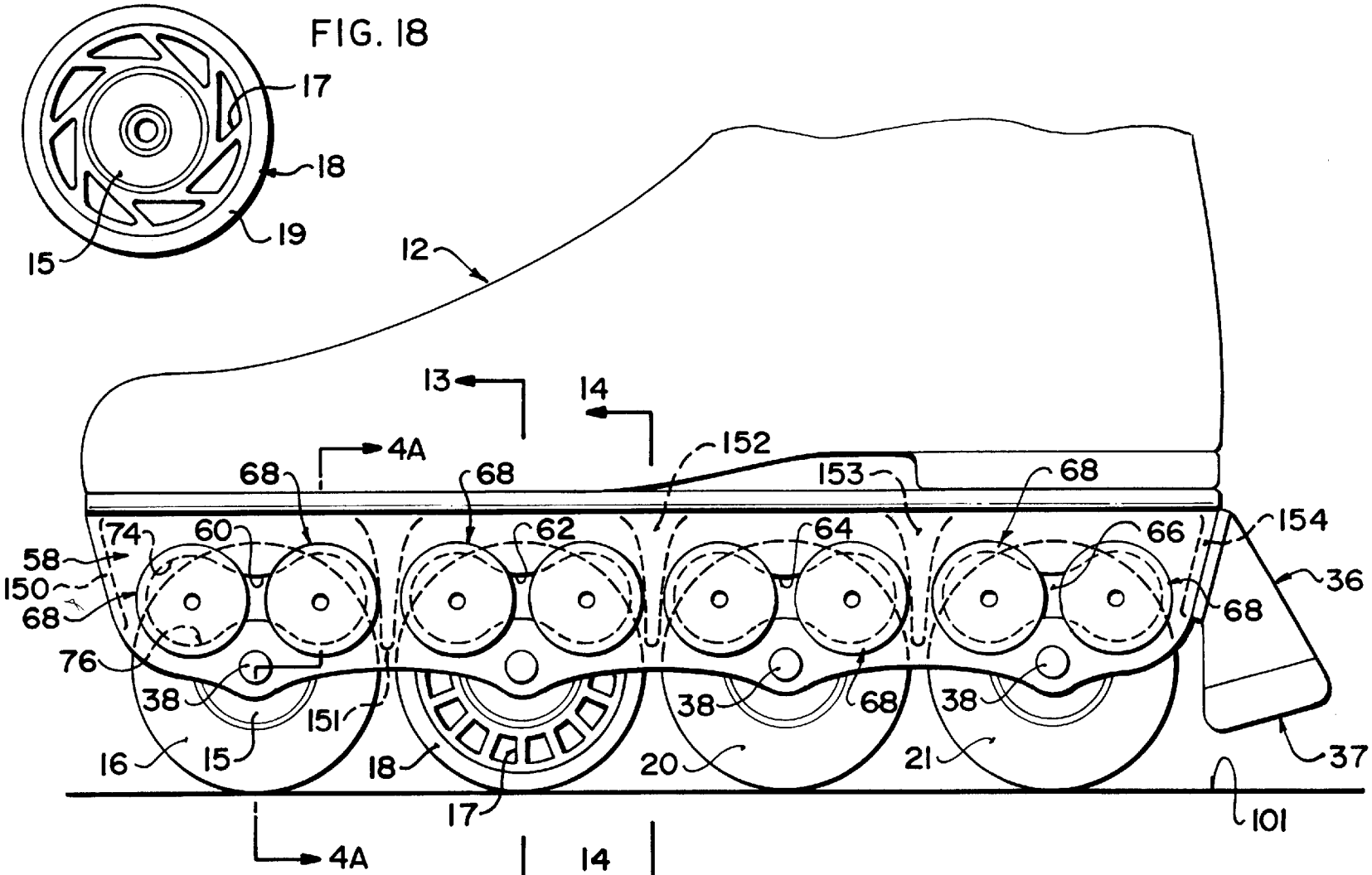
FIG. 4 illustrates a side view of a second embodiment of shock absorbent in-line roller skate and boot design comprising elastic shock absorbing rails with variable density shock absorbing discs in receptacles.
FIG. 18 which appears on the same sheet of drawings as FIG. 4, illustrates a spring action angled spoke shock absorbing wheel.

FIG. 4 illustrates a side view of a second embodiment of shock absorbent in-line roller skate and boot design. As with the previous design, the boot 12 (shown schematically) has four wheels 16, 18, 20 and 21 on the underside thereof, and a brake assembly 36 and pad 37 at the rear end thereof. However, in the second embodiment illustrated in FIG. 4, the pair of parallel side rails 56 and 58 (side rail 58 is visible in FIG. 4) have a different construction. The side rail 58 is typically constructed of a resilient strong material such as extruded high density polyethylene, polypropylene, or some other suitable material, (which can, if desired, be reinforced with glass or graphite fibres) which provides both rigidity, strength and a certain amount of flexibility. The material should be relatively rigid in the linear alignment direction and reasonably flexible in the vertical direction to prevent linear wobble of the wheels out of alignment, but allow some vertical movement of the wheels. The side rail 58 is extruded to have formed therein a series of four dumbbell shaped openings, 60, 62, 64 and 66. The centre of each dumbbell opening 60, 62, 64 and 66 is positioned above the axle 38 of the underlying wheel. The regions between the adjacent ends of each dumbbell opening 60 can be reinforced, if desired, to increase strength and rigidity. Also, the position of the openings, and the shape thereof, can be moved or changed. For instance, the openings need not necessarily be dumbbell shaped. The criteria is to have openings that can deform under compression to allow shock absorption by the wheels.

FIG. 4 also illustrates in dotted lines a series of lateral stabilizing webs 150, 151, 152, 153 and 154 (see also FIG. 14) which lend additional lateral stability to the side rails 56 and 58. These webs assist in preventing the wheels from wobbling laterally out of tandem alignment.

Fitted in the large opening at each end of the dumbbell 60 are a series of spring plugs or discs 68 which are formed of a suitable compressible material, such as a polyurethane elastomer, or the like. These spring plugs or discs 68 act like compression springs and provide shock absorbing capacity to the wheels when the wheels contact bumps or uneven terrain. The spring discs 68 can be exchanged with either softer or firmer versions in order to provide the desired amount of shock absorbing or spring action to the dumbbell 60 and spring disc 68 combination. The elasticity of each disc can be individually selected to customize the bump absorbing action or some or all of the discs may be removed to produce desired shock absorbing action. The degree of elasticity may be chosen with regard skater weight and ability for various road conditions and skating styles. The discs may be colour coded for density e.g. clear or translucent for lighter elements, grading to dark for less resilient discs. Alternatively, the discs may be patterned and coloured for coding or for decorative purposes.

Figure 32:
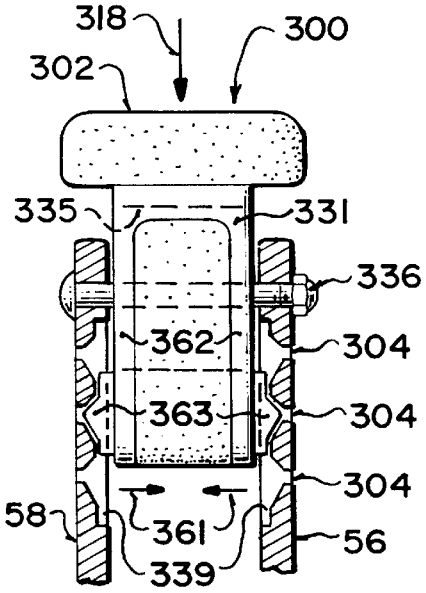
FIG. 32 illustrates a plan partial section view of the front toe wheel lock similar to FIG. 31.

Furthermore, if the openings 60 are moved so that they are positioned between the wheels 16, and the discs 68 are laterally aligned between the wheels 18, the pairs of discs 68 can be connected together with a rod 65 as shown in FIG. 32.

FIG. 4, as an alternative embodiment to solid wheels, illustrates the second forward wheel 18 having an enlarged hub, spoke and rim assembly 17, rather than being solid. Prior art wheels have large solid relatively soft tires to absorb a very limited amount of shock. These tires fail to dissipate heat adequately and thereby increase bearing stresses. These factors generate increasing rolling friction both in the bearing and tire compound. The soft tire compound and bearings of the prior art thus tend to wear more quickly and require more effort to increase speeds. The hub, spoke and rim assembly 17 serves to provide better cooling while the low profile tire inherent with the assembly 17 may be of a harder wear resistant nature. While only one wheel 18 is shown, it will be understood that all four wheels may be of the spoked design.

As a further alternative embodiment, the spoked wheel 18 shown in FIG. 4 may be constructed of different materials and different configurations, for example, see FIG. 18, with angled spokes 17, to provide shock absorbing action or reduction in weight.

FIG. 4A illustrates a section view taken along section-line 4A—4A of FIG. 4. In FIG. 4A, spring discs 68 are shown at each side. For purposes of illustration, a plug remover 69 and hooked rod 71 are shown removing the disc 68 in the opening 60. The discs may be press fitted for installation, with or without a tool. The first side rail 56 extends downwardly from the boot 12 at the left side of the figure, while the parallel side rail 58 extends downwardly the right side of the figure. The dual side rail combination 56, 58 can be injection molded as a unit, and fibre reinforced, which is evident in FIG. 4A. The axle 38 extends through the base regions of the side rail combination 56, 58, and is secured with nut 39 on the opposite side. The axle 38, and nut 39 combination holds the wheel 16 in the interior opening provided by the parallel spaced side rails 56 and 58.

FIG. 4B illustrates, in section view, upper lip 74 and lower lip 76 which are formed in the upper and lower regions of the dumbbell opening 60. The upper lip 74 and lower lip 76 are designed to engage snugly with the groove 78 which is formed around the periphery of the spring disc 68. In FIG. 4B, the upper lip 74 and lower lip 76 are shown having a rounded form, and the groove 78 in the spring disc 68 also has a congruent rounded form. However, the respective configurations can have different designs, for instance, square, triangular, dove-tail, and the like, if greater interaction between the groove 78 and the respective lips 74 and 76 is required. In FIG. 4B, no disc 68 is shown in the left side opening 60. This can be by design. As a rule, however, discs 68 are normally installed on both sides.

The spring disc 68, as seen in FIG. 4A, is in a non-compressed configuration. However, when the wheel 16 encounters a bump or an obstruction of some sort (level 102), the wheel 16 is forced upwardly, as illustrated in FIG. 4B, which illustrates a section view taken along section line 4A—4A of FIG. 4, except in the depiction illustrated in FIG. 4B the roller wheel 16 is under upward compression. The initial position of wheel 16 is indicated by dashed lines 72. The upward movement of the wheel 16 forces the axle 38, nut 39 to move upwardly as indicated by dashed lines 73. As is evident in FIG. 4B, this upward action compresses dumbbell opening 60, and spring disc 68. Spring disc 68 absorbs the upward compressive force by contracting vertically and expanding laterally. A similar action would take place in a companion spring disc 68 if it were fitted in left dumbbell opening 60. The spring disc 68 has an opening 70 through the centre thereof. The size of this opening 70 can be varied in order to provide increased control over compressibility of the spring disc 68. As a general rule, the larger the spool opening 70, the more resilient is the spring disc 68. However, compressibility is also governed by the degree of elasticity of the elastomeric material from which spring disc 68 is formed. The opening is also used to enable the disc 68 to be installed or removed by disc remover 69 as shown in FIG. 4. Further embodiments of wheel discs are discussed below and illustrated in FIGS. 19 to 24.

Figure 4C:
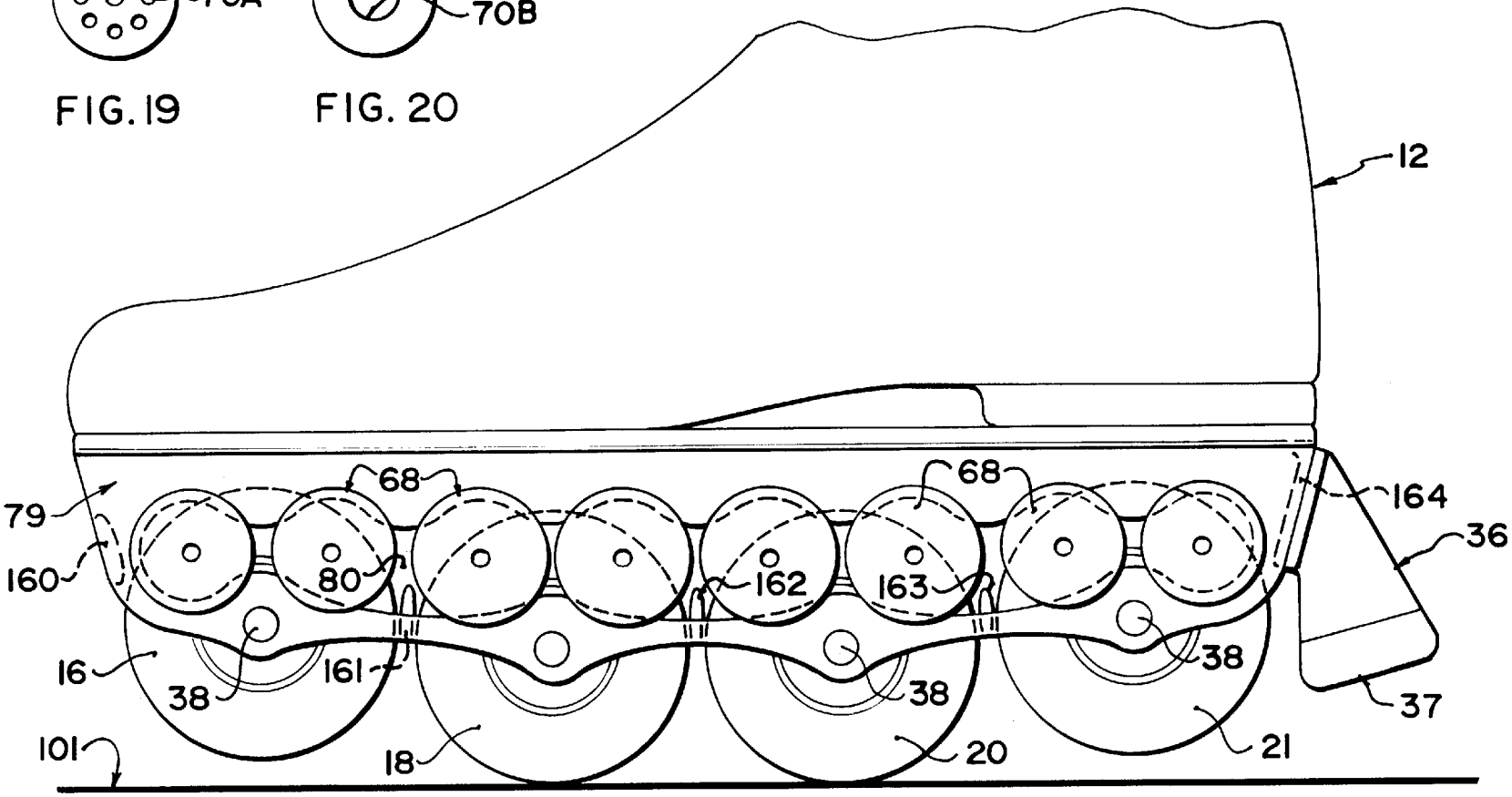
FIG. 4C illustrates a side view of a third embodiment of shock-absorbent in-line roller skate.

FIG. 4C illustrates a side view of a third embodiment of shock-absorbent in-line roller skate. As seen in FIG. 4C, the four wheels 16, 18, 20 and 21 are arranged in an arc configuration so, in the embodiment shown in FIG. 4C, only the two centre wheels 18 and 20 touch the ground 101. In certain instances, for example, where increased maneuverability is required, it may be desirable to have the forward wheel 16 and the rear wheel 21 raised above the two middle wheels 18 and 20. The forward wheel 16 and the rear wheel 28 would then only contact the ground under certain conditions. The lower side rail linking the four axles 38 of the four wheels 16, 18, 20 and 21, can be designed of a resilient material to have a vertical bowing action, and a relatively rigid linear configuration. Thus the wheels 16, 18, 20 and 21 can yield upwardly a certain amount when subjected to the weight of the skater or when the wheels encounter bumps on the pathway. This lower bowed region of the rail 79 can be post-tensioned or pre-tensioned, as required, in order to accommodate the elasticity of the discs 68, and provide the proper amount of shock absorbing action.

As seen in FIG. 4C, the side rail 79, rather than having formed therein a series of four dumbbell openings, as shown in FIG. 4, has formed therein a single continuous undulating "string of beads" type opening, in which the spring discs 68 are fitted. The discs 68 can have uniform or varying degrees of elasticity as required to provide the proper shock absorbency action. The central discs can be of a larger diameter than the end discs. As with the design illustrated previously in FIG. 4, there is a pair of spring discs 68 for every wheel and axle combination. Again, the side rails 58 and 56 (not visible) are formed of appropriate resilient material to provide a certain amount of flexibility, so that the dimensions of the continuous undulating opening 80 will compress upwardly to a certain extent, when the wheels 16, 18, 20 and 21 impact the ground, or obstructions on the ground. The compression action of the opening 80, however, is controlled both by the degree of resiliency of pre- or post-tensioning of the linking area between the axles 38 and by the degree of compressibility provided by the spring discs 68. FIG. 4C also illustrates in dotted lines lateral stabilizer webs 160, 161, 162, 163 and 164, which give lateral stability to the rails 79. Thus the lower bow-like region of the rails 79 can move upwardly or downwardly to provide shock absorbing action but movement in a lateral direction is minimized by the stabilizer webs 160, 161, 162, 163 and 164.

It will be understood that other types of resilient shock absorbing members, such as coil springs (see FIG. 35) or elastomer plugs, or other types of yielding shock absorbing devices, can be substituted for the discs 68, without departing from the spirit of the invention.

Figures 4D, 21, 22:
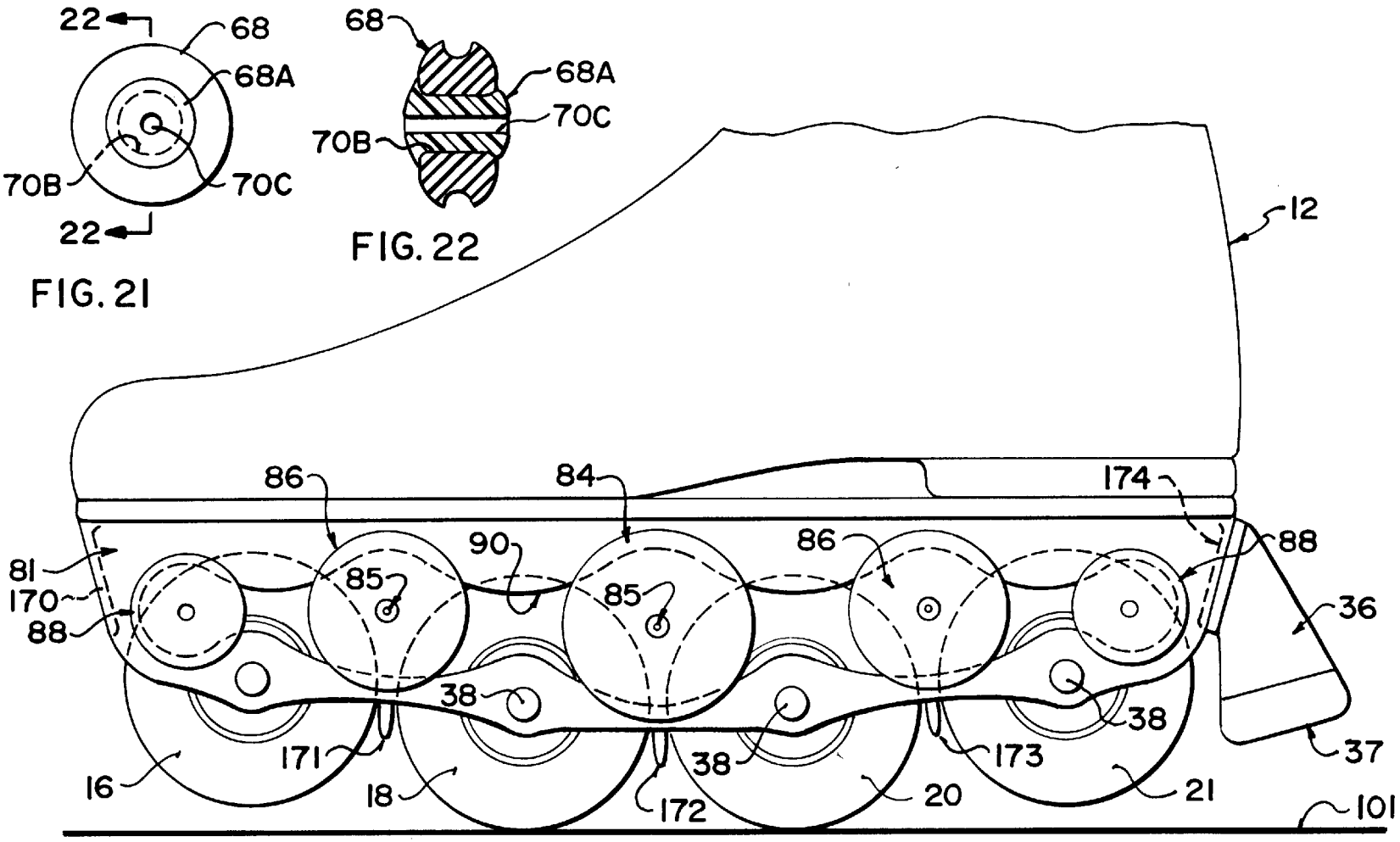
FIG. 4D illustrates a side view of a fourth embodiment of shock-absorbent in-line roller skate.
FIG. 21 which appears on the same sheet of drawings as FIG. 4D, illustrates a means of adjusting the density of the disc of FIG. 20.
FIG. 22 which appears on the same sheet of drawings as FIG. 4D, illustrates a section view taken along section line 22—22 of FIG. 21.
Figure 4E:
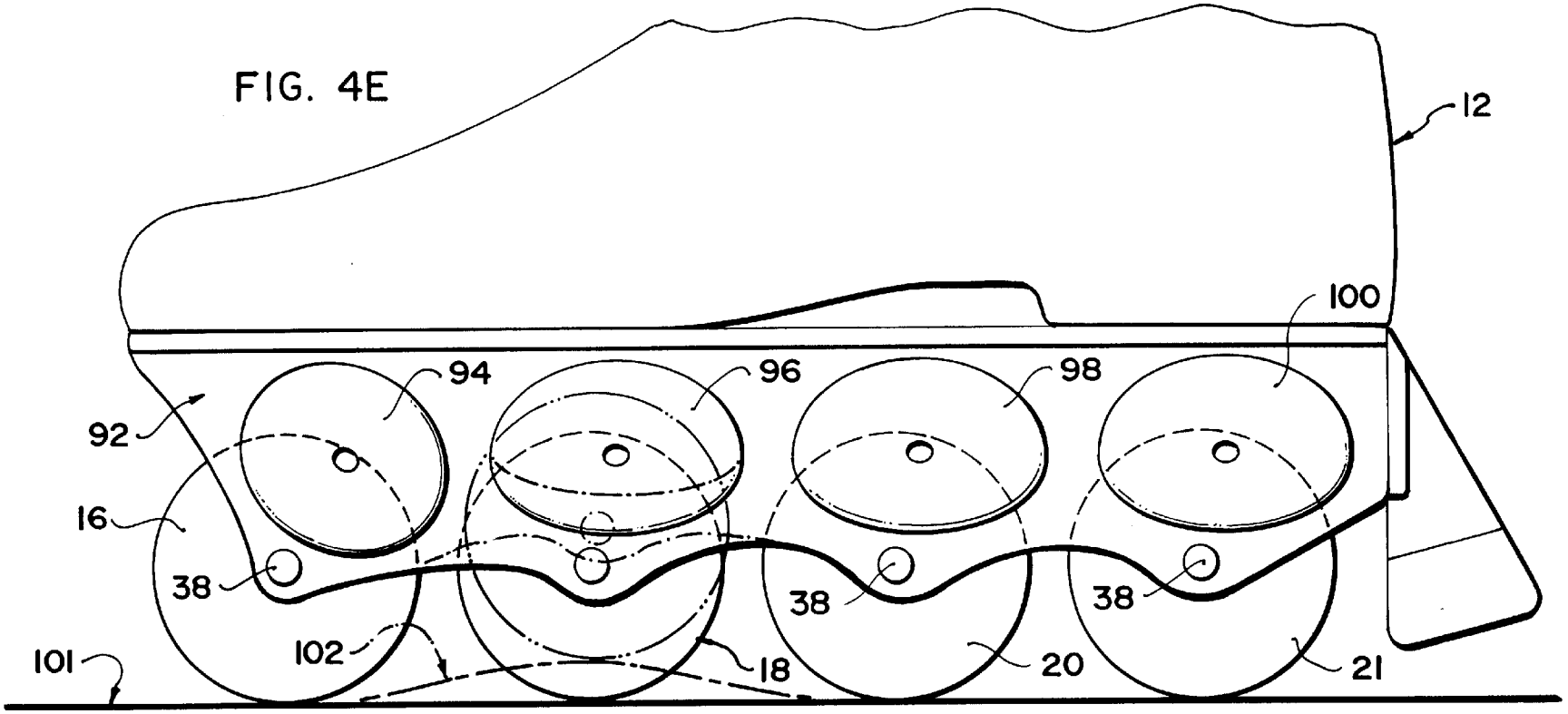
FIG. 4E illustrates a side view of a fifth embodiment of shock-absorbent in-line roller skate.

FIG. 4D illustrates a side view of a fourth embodiment of shock-absorbent in-line roller skate. The design illustrated in FIG. 4D is similar to a certain extent to that illustrated in FIG. 4C, except that the undulating opening 90, is formed (or deformed by pre- or post-tensioning) so that it accommodates significantly different sizes of spring discs. Also, the middle three discs 86 as seen in FIG. 4D have air valves so that the internal air pressure can be adjusted. As seen in FIG. 4D, there are five spring discs, arranged so that they fit on the outsides and the interiors of the four axles of the four wheels 16, 18, 20 and 21. A single large size hollow air filled spring disc 84 is fitted into the central portion of the opening 90, between the middle wheels 18 and 20. A pair of medium size air filled spring discs 86, are fitted between the two forward wheels 16 and 18, and the latter two wheels 20 and 21. A pair of small exterior spring discs 88, are fitted in the two ends of the opening 90. The action provided by the embodiment illustrated in FIG. 4D is similar to that provided by the previous embodiments, but represents a alternative means of achieving the shock absorbent, compressible wheel design provided by the invention. As illustrated, spring disc 85 and discs 86 are oversized to lower the centre wheels 18 and 20 relative to wheels 16 and 20, to provide a convex curved ground contacting wheel bottom profile, but may be replaced with smaller discs to allow all wheels to contact the ground simultaneously. FIG. 4D also illustrates lateral stabilizer webs 170, 171, 172, 173 and 174. (See also FIG. 14.) FIG. 4E illustrates a side view of a fifth embodiment of shock-absorbent in-line roller skate. As seen in FIG. 4E, four discs, 94, 96, 98 and 100, are fitted in oval openings formed in side rail 92. Again, the shape of the openings can be changed as required. Oval openings are shown as an example. The four discs, 94, 96, 98 and 100 are positioned above and slightly to the rear of the respective axles 38 of the respective wheel 16, 18, 20 and 21. However, to provide the shock absorbing capacity along the force line that would be generated by wheel 16 impacting a bump, or the like, the front spool 94 is positioned slightly farther behind axle 38 of front wheel 16, than with the other three discs.

FIG. 4E illustrated by means of dashed lines 102, the manner in which wheel 18 reacts when it impacts a bump indicated by dashed line 102. The wheel 18 moves upwardly, thereby compressing disc 96, into a more oval shape configuration. A resiliency of the disc 96 absorbs the upward compressive force, and thereby enables wheel 18 to negotiate the bump 102 readily. The wheels 16, 18, 20 and 21 provide independent suspension because they all act independently as the skate proceeds and the bump 102 moves under each wheel in sequence.

FIG. 4F illustrates an isometric view of resilient shock absorbent spring disc 68. The spring disc 68 has a general disc-like configuration, with a peripheral groove 78 around its circumference. Disc opening 70 is also indicated in the central area of the spring disc 68, and penetrates through the interior of the spring disc 68. This opening 70 can vary in size in order to regulate the degree of elasticity of the disc 68. It can also be used to receive plug remover 69 for installation or removal on the skate rail.

FIG. 4G illustrates a partial section view of an embodiment of the invention with air-filled discs. The discs 77 are at an angle to avoid any interference with wheel movement under severe compression. The discs 77 are hollow so that they can be air filled via valves 85. The air can be pumped in by pump 78 and needle 83. The manner in which the discs compress when wheel 16 contacts a bump 102 is indicated in dashed lines. The pump 78 can be of small size and clamped to or incorporated in boot 12.

Figure 5A:
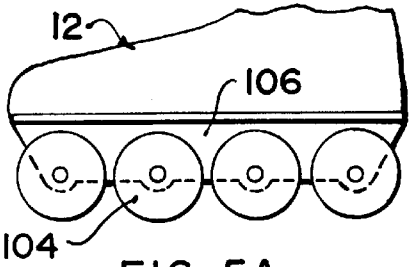
FIG. 5A illustrates a side view of the dual wheel in-line roller skate illustrated in FIG. 5.
Figure 5:
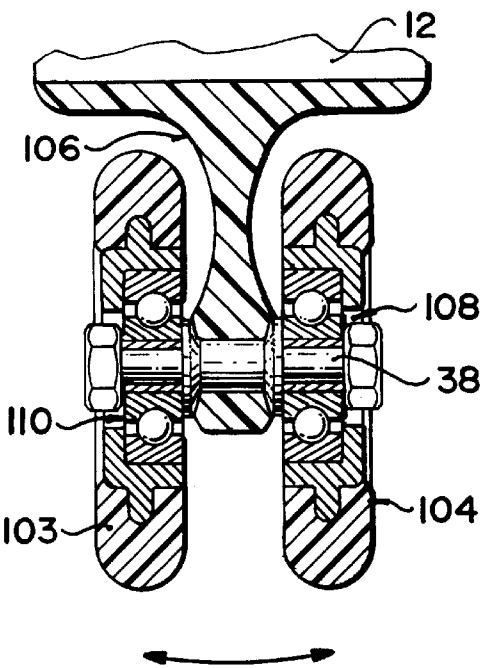
FIG. 5 illustrates an end section view of a first embodiment of a lateral dual wheel in-line roller skate.

FIG. 5 illustrates an end section view of a dual wheel in-line roller skate. The boot 12 as seen in FIG. 5 has on the underside thereof two parallel rows of wheels 102 and 104 mounted by axle 38 to a central mount 106. This dual wheel in-line roller skate design is also adapted to absorb shocks and bumps as will be explained below.

Figure 6A:
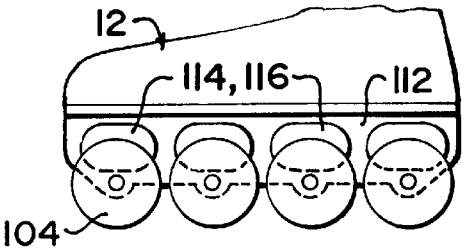
FIG. 6A illustrates a side view of the dual wheel in-line roller skate illustrated in FIG. 6.

In the end section view illustrated in FIG. 5, the first wheel 102 is paired with a second wheel 104, both of which are rotatably mounted on a common axle 38, and are rotatable about respective ball bearings 108 and 110. The pair of wheels 102 and 104 are fixedly mounted on a central dual wheel mount 106, which is secured to the undersigned of the boot 12. The central dual wheel mount 106 is constructed, such as by extrusion molding, from a strong semi-rigid material which has a certain amount of lateral "give" to it. The degree of stiffness of the material from which the wheel mount 106 is constructed can be varied as required. Reinforcing with glass or graphite fibres may be advisable. FIG. 6A illustrates a side view of the dual wheel construction with four pair of wheels 102 mounted in spaced relation rotatably on central dual wheel mount 106, which is secure d to the underside of boot 12.

As indicated by the double ended arrow in FIG. 5, the pair of wheels 102 and 104 can move laterally due to the semi-flexibility of the central dual wheel mount 106. This action enables each wheel 102 and 104 to negotiate individually a bump or an obstruction. The result is that the four pair of wheels on the skate (see FIG. 5A) are adapted to yield to obstructions on the surface over which the skater is travelling.

Figure 6:
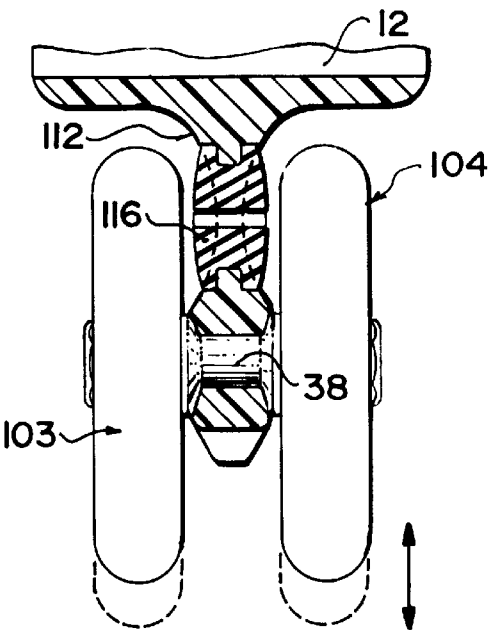
FIG. 6 illustrates an end-section view of a second embodiment of a lateral dual wheel in-line roller skate.

FIG. 6 illustrates and end section view of the second embodiment of the dual wheel in-line roller skate. FIG. 6A illustrates a side view of the dual wheel in-line roller skate illustrated in FIG. 6. The dual wheel design illustrated in FIGS. 6 and 6A vary from that illustrated in FIGS. 5 and 5A in that the central mount 112 has formed therein a plurality of openings 114, into which can be fitted resilient spring discs 116. The action provided by this combination is similar to that described previously for the openings and the spring disc combinations described for the single in-line roller skate designs illustrated in FIGS. 4, 4A, 4B, 4C, 4D, 4E, 4F and 4G.

The configuration illustrated in FIG. 6 and 6A enables lateral movement and vertical wheel movement to be achieved, as indicated by the pair of double headed arrows.

Figure 7A:
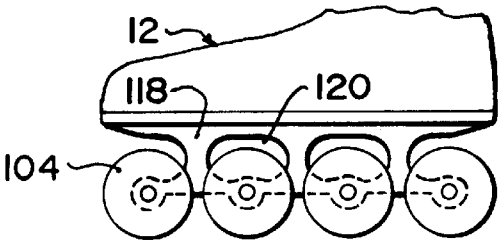
FIG. 7A illustrates a side view of the dual wheel in-line roller skate illustrated in FIG. 7.
Figure 7:
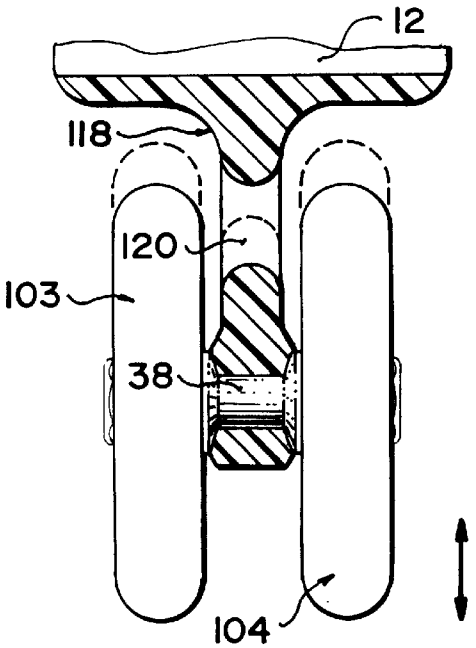
FIG. 7 illustrates a end-section view of a third embodiment of a lateral dual wheel in-line roller skate.

FIG. 7 illustrates an end section view of a third embodiment of a dual wheel in-line roller skate. FIG. 7A illustrates a side view of the roller skate design illustrated in FIG. 7. In this design, the central wheel mount 118 has an "open-ended" design, with two central openings 120. This design also has lateral and vertical dual wheel movement, as indicated by the pair of double headed arrows in FIG. 7. The material from which central mount 118 is constructed can be selected to provide the requisite amount of flexibility and shock absorbing capacity. A semi-rigid resilient plastic material such as density polyethylene, high density polypropylene, suitable reinforced with fibreglass or graphite filaments, or the like, can be utilized.

The three embodiments of dual wheel in-line roller skate design illustrated in FIGS. 5, 5A, 6, 6A, 7 and 7A show the wheels mounted in pairs. In each case, the pair of wheels can move upwardly or downwardly by compressing the openings or in a lateral direction about the central dual wheel mount which is constructed of a suitable resilient material.

Most bumps and obstructions encountered by a skater as he or she skates over the ground are not very large and accordingly it is unlikely that each of the dual wheels will encounter the same bumps simultaneously. Thus, when one of the dual wheel pairs encounters a bump, it is able to move upwardly relative to the other dual wheel, and thereby absorb at least a portion of the impact caused by the bump. The pair of wheels are also able to move laterally. This pivotal dual wheel configuration provides a more smooth operating and shock absorbing in-line skate design, than the conventional in-line roller skate design where the wheels are rigidly mounted to the frame.

With the dual wheel mounting, one or both of the wheels are free to move upwardly against the compression force exerted by the central mound, with or without spring discs, when one or both wheels encounter a bump or obstruction the ground surface over which the skater is skating. This construction provides a very smooth operating dual wheel in-line roller skate. Furthermore, when the skater negotiates a turn, and "leans" into the turn, the wheel mounting flexes somewhat and enables the inner wheel to yield more than the outer wheel, as the case may be, thereby enabling all wheels to remain in contact with the ground surface, even though the skater is leaning into the turn. It is important, however, that the dual wheel mount 106 be kept relatively stiff so that the wheels stay aligned to a reasonable degree. If the wheels are permitted to wobble too greatly, the stability of the skate and the degree of control that the skater has over the skate are reduced. This balancing of relative resiliency and stiffness is an engineering choice.

Figure 8:
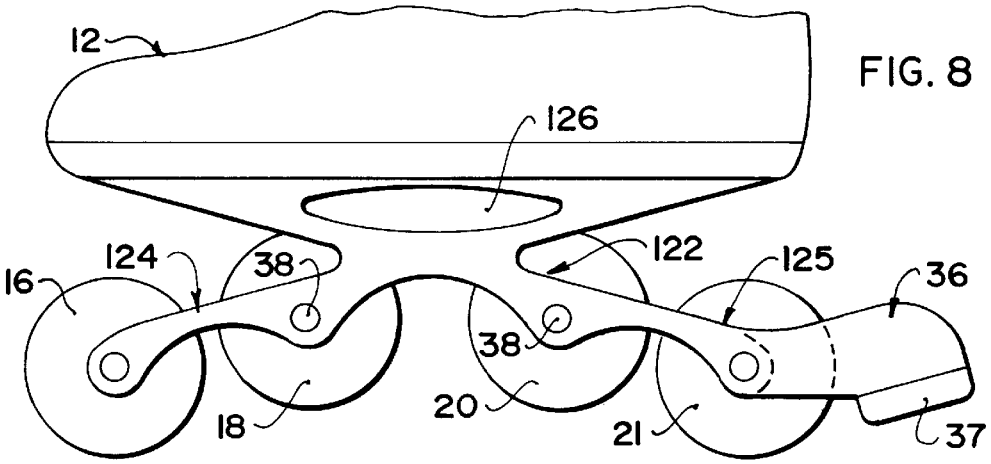
FIG. 8 illustrates a side view of an in-line roller skate with spring yoke wheel suspension.

FIG. 8 illustrates a side view of an in-line roller skate with spring yoke wheel suspension, shown in an unstressed condition. In this design, the four wheels 16, 18, 20 and 21, are mounted on a yoke-like wheel suspension 122, which is secured to the underside of the boot 12. FIG. 8 illustrates the arrangement the wheels and the yoke 122, which is constructed of a semi-ridge spring-line resilient material, such as flexible metal alloys, graphite fibre, or similar material, used in bicycle forks and frames, tennis rackets, or similar sports equipment constructions. The front pair of wheels 16 and 18 are mounted on the forward portion 124 of the yoke. Wheels 20 and 21 are rotatably mounted on the rear portion of the yoke 122.

Figure 8A:
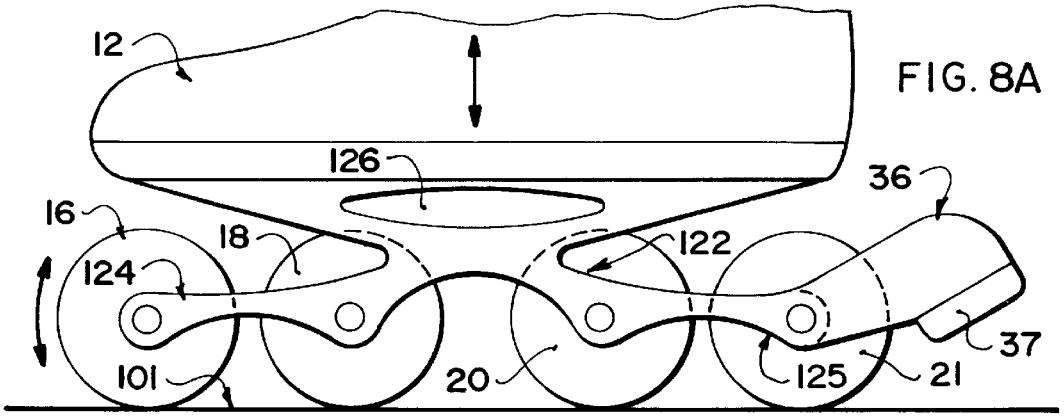
FIG. 8A illustrates a side view, of an in-line roller skate with spring yoke wheel suspension, when contacted with the ground and under a limited load.
Figure 8B:
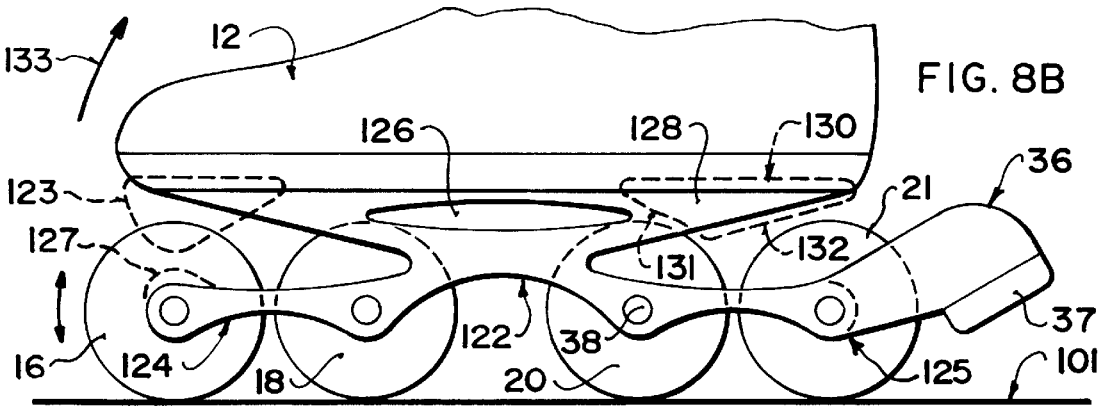
FIG. 8B illustrates a side view of an in-line roller skate with spring yoke wheel suspension, when subjected to further ground compression action, compared to the configuration illustrated in FIG. 8A.
Figure 11:
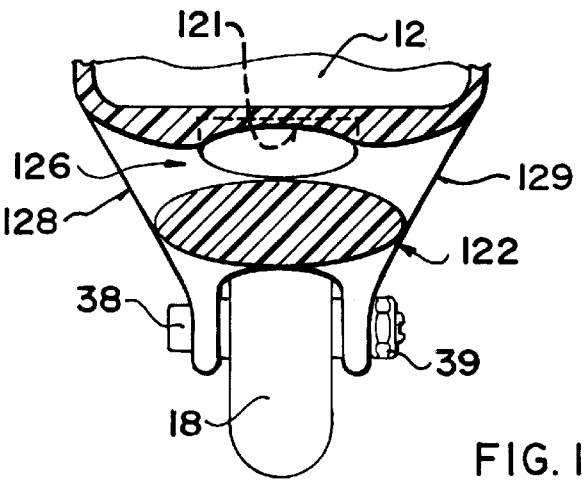
FIG. 11 illustrates a section view taken along section line 11—11 of FIG. 9.

When the skater wearing the boot 12, contacts the ground, the forward and rear arms 124 and 125 of the yoke 122 yield upwardly as illustrated in side view perspective in FIG. 8A. This action is illustrated by the vertical double headed arrow on boot 12. As the skater applies more weight, the yoke 122, by means of the compression action provided by elongated oval opening 126, provides further shock absorbing and compression force absorbing action as seen in FIG. 8B. FIG. 8B illustrates in dotted lines an optional set of upper and lower front bumpers 123 and 127 which prevent the forward wheel 16 from bumping and stalling against the underside of boot 12, when wheel 16 encounters a large bump. As shown in FIG. 11, the upper front graded bumper 123 can be inserted into a socket 121 formed between side rails 128 and 129 and below boot 12.

FIG. 8B also illustrates in dotted lines a wedge-like graded braking pad 130 which may be inserted into a rear socket under the heel of the boot 12 similar to socket 121. As viewed in FIG. 8B, the graded braking mechanism acts as follows: When the toe of the boot 12 is rotated upwardly, as shown by upward arrow 133, initial braking commences when third wheel 20 contacts surface 131 of the pad 130. This begins to apply a mild braking action to wheel 20 while still allowing contact of front toe wheel 16 and second wheel 18 with the ground surface. Further upward rotation of the toe of the boot 12 increases the braking action applied to wheel 20 and initiates braking action between under surface 132 of pad 130 and wheel 21. Meanwhile, toe wheel 16 remains in ground contact permitting continued directional control. Continued upward toe rotation, in the direction of arrow 133, finally engages brake pad 37 with the ground surface 101. This also applies progressively more braking force to wheels 20 and 21 and in combination increases overall braking effectiveness. Bumper 123 and brake pad 130 can be removably replaced with similar shaped elements of varying physical characteristics of elasticity and wear. The in-line roller skate design illustrated in FIG. 8, 8A and 8B by selecting the appropriate constructing material for the yoke 122, can provide a cushioning-type action to the skate.

Figure 9:
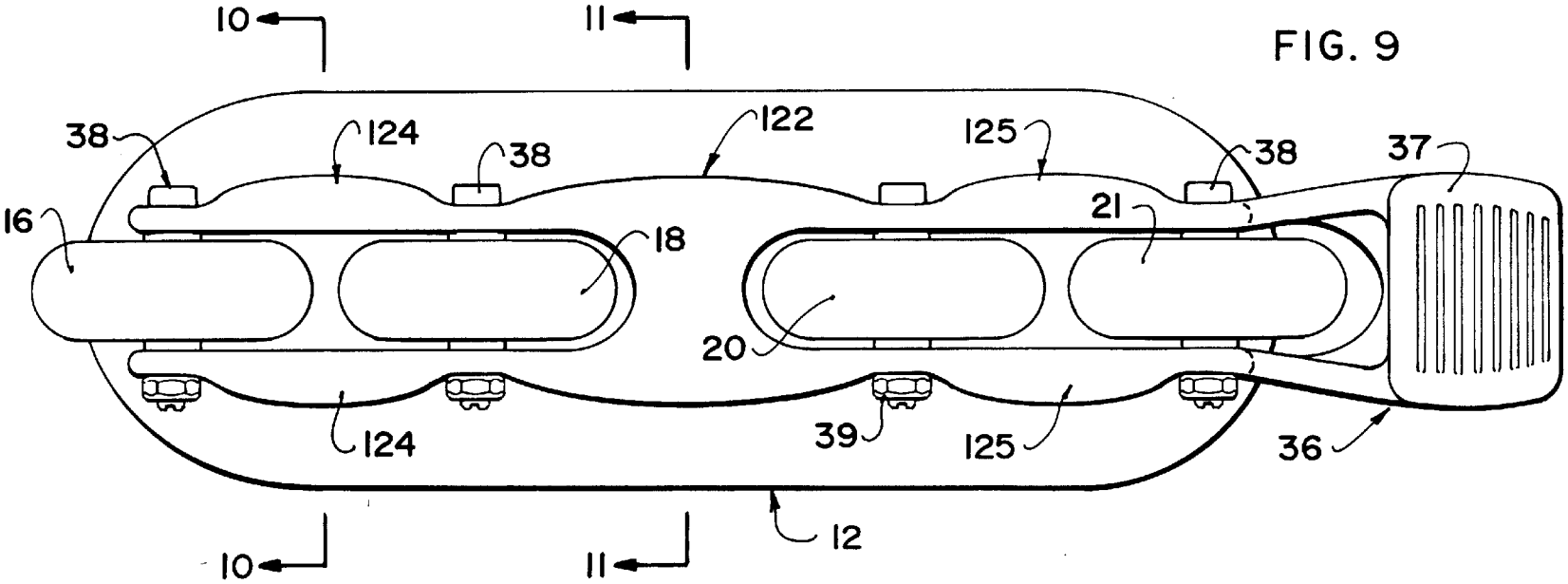
FIG. 9 illustrates a bottom view of an in-line roller skate with spring yoke wheel suspension.

FIG. 9 illustrates a bottom view of an in-line roller skate with spring yoke wheel suspension, as illustrated FIGS. 8, 8A and 8B. The forward arm 124 of the yoke and the rear arm 125 of the yoke 122 are forked, thereby providing openings in the interior in which the wheels 16, 18, 20 and 21 can be rotatably mounted respectively by axles 38.

Figure 10:
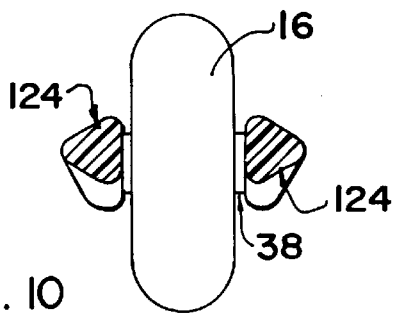
FIG. 10 illustrates a section view taken along section line 10—10 of FIG. 9.

FIG. 10 illustrates a section view taken along section 10—10 of FIG. 9. The wheel 16 is shown rotatably mounted on axle 38, which is held by forward yoke arm 124. FIG. 11 illustrates a section view taken along section 11—11 of FIG. 9. Wheel 18 is rotatably mounted on axle 30 38, nut 39 combination, which is mounted in yoke 122. The opening 126 is also indicated. The yoke 122 is secured to the underside of the boot 12.

Figure 12:
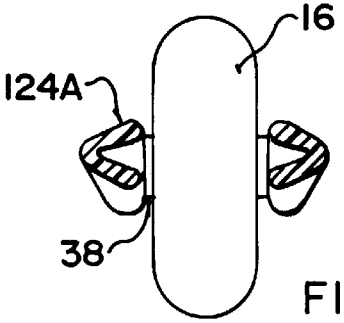
FIG. 12 illustrates a section view taken along section line 10—10 of FIG. 9 of an alternative embodiment of hollowed-out lightweight yoke supports.

FIG. 12 illustrates a section view taken along section line 10—10 of FIG. 9 with an alternative embodiment of hollowed-out lightweight yoke supports. The yoke supports 124A are constructed of strong, lightweight, resilient material and are hollowed out to reduce weight while maintaining lateral rigidity and allowing resilient vertical movement to carry axle 38 and wheel 16.

Figure 13:
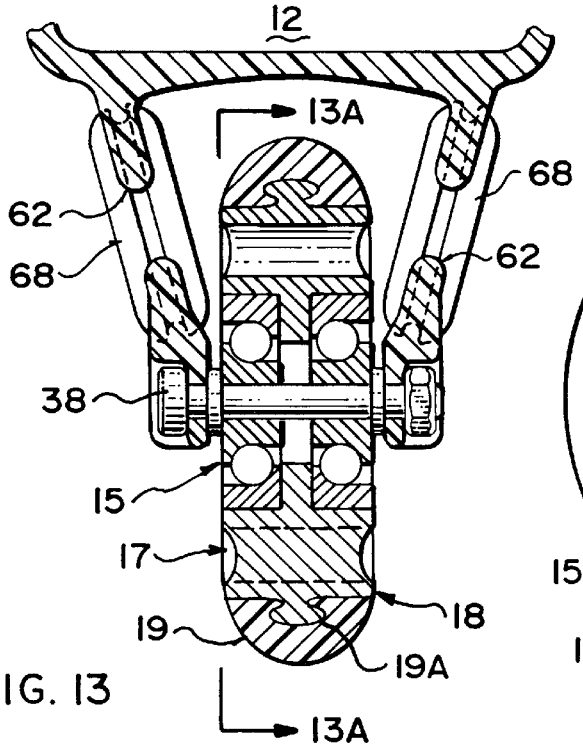
FIG. 13 illustrates a section view taken along section line 13—13 of FIG. 4, showing a lightweight wheel assembly with a low profile tire.

FIG. 13 illustrates a section view taken along section line 13—13 of FIG. 4. The section line 13—13 passes through the narrowest part of the dumbbell shaped disc receiving cavity 62. This central portion of the opening 62 serves as a bumper preventing wheel contact with the sole plate of the boot 12 thereby avoiding inadvertent braking of the wheels in extreme upward wheel movement situations. FIG. 13 shows inter alia a lightweight composite wheel 18, including a metal or plastic bearing housing hub, spoke and rim element 17 mounting a low-profile ground engaging tire 19 with good wear characteristics. Low-profile tires are currently popular in the automobile industry. The spokes with their adjacent openings serve to lighten the overall weight of the wheels. They also serve to conduct unwanted heat away from the circumference of the wheels, axles and bearings by allowing circulating air between the radial spoke members. The tire is mounted on the rim element 17 which may include a tire engaging annular ring 19A. As the shock absorption in taken within the rail members, and/or the elements 17, if constructed of resilient material, the tires 19 may be constructed of generally firm material such as hard rubber or plastic such as polyurethane, neoprene, or polybutadiene. In extreme situations the tire compound may even include imbedded hard particulates or grit for grip on slippery surfaces such as ice. The particulates may be coarse or fine and of metal, sand or other suitable friction enhancing materials.

Figure 13A:
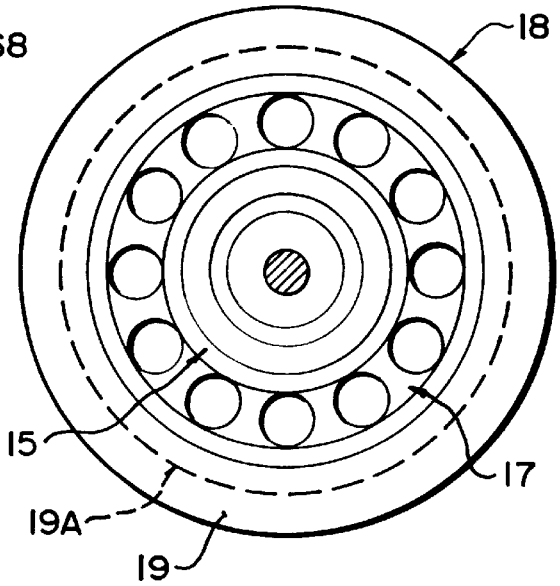
FIG. 13A illustrates a view of the wheel of FIG. 13 taken along section line 13A—13A of FIG. 13.

FIG. 13A illustrates a side view of a wheel 18 with the vented spokes in the element 17 mounting the bearings 15 and low-profile tire 19. The position of the annular tire anchoring ring 19A is shown in dotted lines. The ring 19A aids in bonding the tire 19 to the rim of wheel element 17. Adhesive may be used. Referring to FIG. 15, bonding may be further enhanced through boring of a plurality of radial spaced apart holes 17A, in the rim of element 17 and spaced apart annular holes 19B, in tire anchor 19A.

Figure 14:
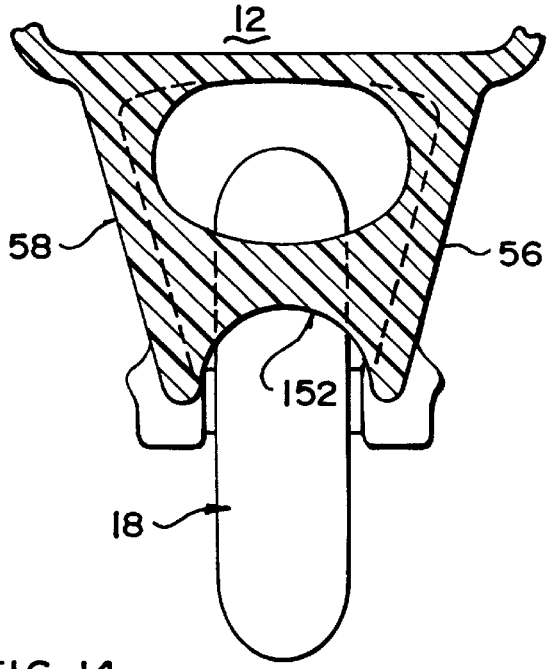
FIG. 14 illustrates a section view taken along section line 14—14 of FIG. 4, showing a lateral stabilizer web in the wheel support rail.

FIG. 14 illustrates a section view taken along section line 14—14 of FIG. 4, showing a lateral stabilizer web 152.

These stabilizer webs 150, 151, 152, 153, and 154 can be hollow, semi-hollow or of a lattice structure to reduce weight, and lend lateral stability to the side rails and prevent wander, wiggling or wobbling of the in-line wheels, which can lead to instability in the skate, if excessive.

FIG. 15 illustrates a detail section view of an in-line roller skate wheel and support with axle-mounted resilient shock absorbing axle plug. As seen in FIG. 15, a pair of resilient shock absorbing plugs 200 are positioned between the wheel supporting rails 202 and a pair of respective spacer sleeves 204 which fit over the axle 206 at each end. The plugs 200 are confined at the opposite side by respective washers 208. The sleeves 204 and washers 208 have extended vertical flanges 205 and 209 respectively which contain the plug member 200 and can be constructed of a suitable lightweight plastic such as polyethylene or metal such as aluminum. This construction enables the axle 206 to yield upwardly to bumps and obstructions to which the wheel may be subjected when the skater is traversing over uneven terrain.

Figure 15A:
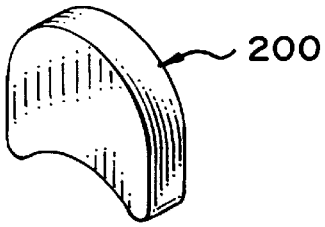
FIG. 15A, which appears on the same sheet of drawings as FIGS. 13 and 14, illustrates an isometric view of a resilient shock absorbing axle plug.

FIG. 15A, which appears on the same sheet of drawings as FIGS. 13 and 14, illustrates an isometric view of a resilient shock absorbing axle plug 200. The plug 200 has a basic crescent shape and is constructed of suitable resilient material. The degree of resilience can be selected to accommodate the degree of shock absorbing ability desired.

Figure 15B:
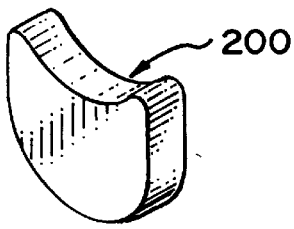
FIG. 15B, which appears on the same sheet of drawings as FIGS. 13 and 14, illustrates an isometric view of an inverted shock absorbing axle plug.
Figure 15:
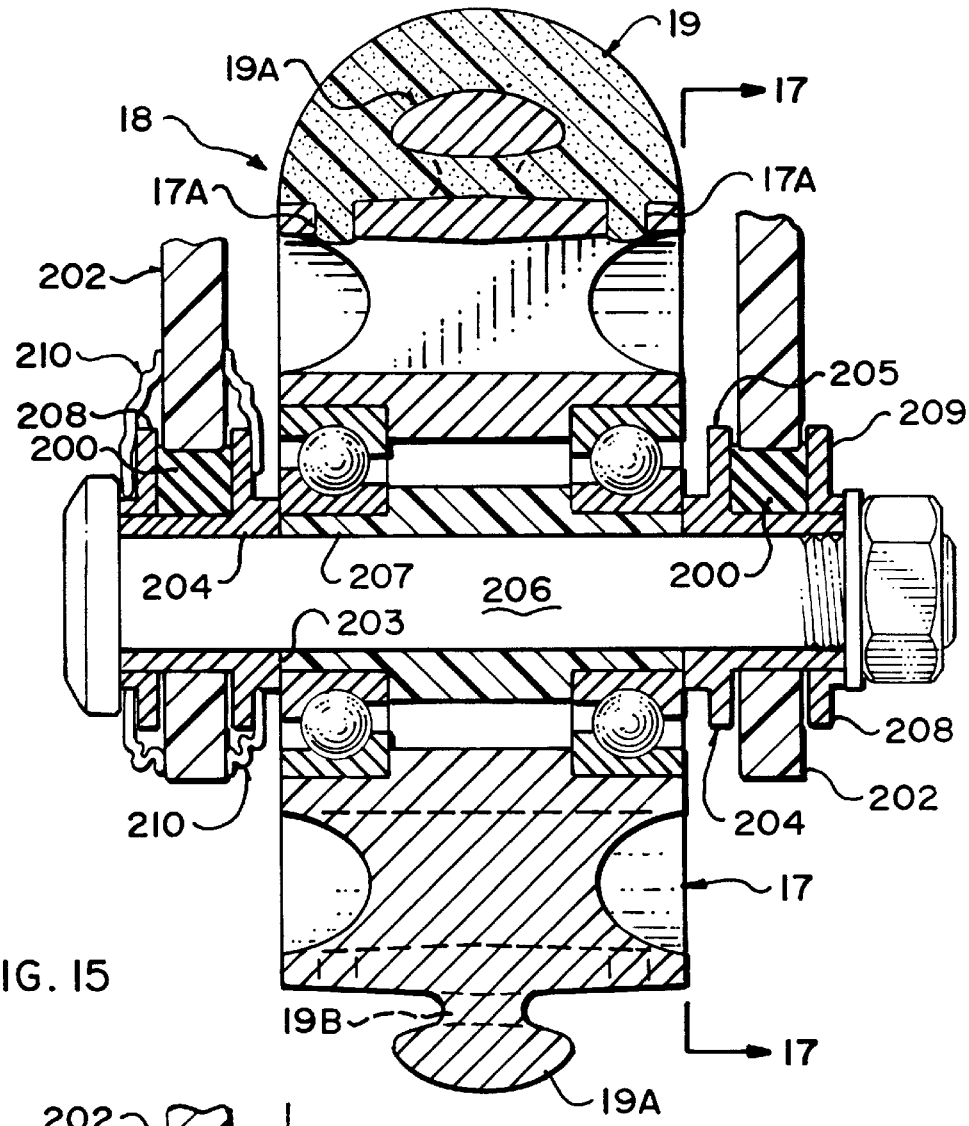
FIG. 15 illustrates an enlarged section view of an in-line roller skate wheel and support with a pair of axle-mounted resilient shock absorbing axle plugs and tire mounting means.

FIG. 15B, which appears on the same sheet of drawings as FIGS. 13 and 14, illustrates an isometric view of the axle shock absorbing plug 200 in inverted configuration. In certain situations, it may be desirable to raise the elevation of the axle 206 and this can be done by inverting the two plugs 200 and placing them beneath the axle 206.

Figure 16:
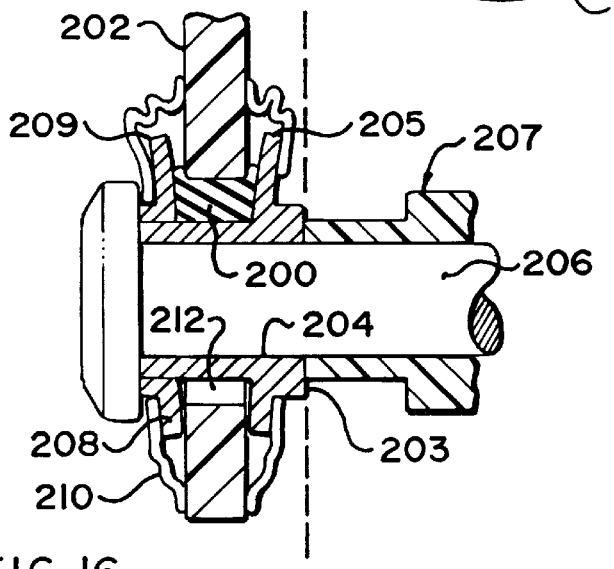
FIG. 16 illustrates a section view of a detail of the axle and resilient shock absorbing axle plug of FIG. 15 under compression.

FIG. 16 illustrates a section view detail of the axle and resilient shock absorbing plug of FIG. 15 under compression. In this view, the vertical movement of the axle 206 in the vertical slot 212 is evident. The plug 200 is compressed and thus permits the axle 206 to yield upwardly. Alignment of plug enclosing flanges 205 and 209, and of spacer 204 and washer 208 respectively, may be accomplished by using a splined bore in washer 208 thereby interfacing matching splines on spacer 204. End face 203 may have splines (not shown) which mate with matching splines (not shown) at the interface with bearing spacer 204. Axle 206 may be shaped to prevent rotation within the axle slot 212. An optional protective dust cover 210 can be installed.

Figure 17:
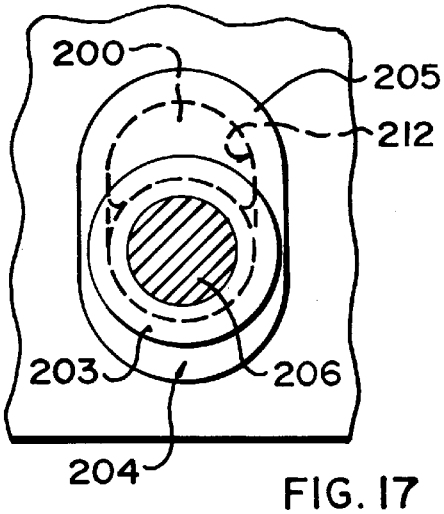
FIG. 17 illustrates a section view taken along section line 17—17 of FIG. 15.

FIG. 17 illustrates a section view taken along section line 17—17 of FIG. 15. This view reveals an end elevation of the spacer 204 with its vertical plug containment flange 205. During impact with a bump, axle 206 and spacer sleeve 204 move upwardly, within slot 212, thereby compressing plug 200 and absorbing shock.

FIG. 18, which appears on the same sheet of drawings as FIG. 4, illustrates a second embodiment of shock absorbing wheel. In this view, the wheel 18 has angled resilient spokes 17, which yield under force and enable the wheel 18 to absorb compression forces. The spokes 17 can be formed of a resilient elastic shock absorbing material such as rubber or plastic, while the wheel circumference can be formed of a wear resistant ground gripping material such as polyurethane.

Figure 19:
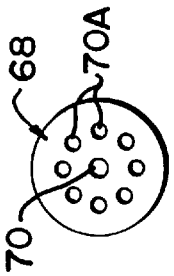
FIG. 19 which appears on the same sheet of drawings as FIG. 4C, illustrates a means of varying disc density.

FIG. 19, which appears on the same sheet as FIG. 4C, illustrates a means of controlling the resiliency of disc 68 by adjusting density using a plurality of holes 70A in addition to central hole 70. Although not shown these holes may be retroactively filled with a suitable filler to increase density.

Figure 20:
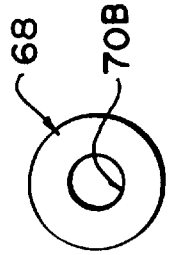
FIG. 20 which appears on the same sheet of drawings as FIG. 4C, illustrates a further means of varying disc density.

FIG. 20 illustrates a further means of varying resiliency by using a larger diameter cavity 70B in the disc 68.

FIGS. 21 and 22, which appear on the same sheet as FIG. 4D, illustrate in front and section view a means of adjusting the resiliency of the disc 68 in FIG. 20 by retrofitting a further plug 68A of some determined density into bore 70B. The plug 68A may be press fitted into bore 70B or be removed using a tool 69, as described earlier. Disc 68 may subsequently be removed by using a finger which is inserted into bore 70B and then is used to pry out the disc.

Figure 23:
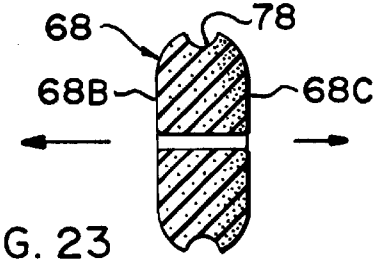
FIG. 23 which appears on the same sheet of drawings as FIG. 4E, illustrates a graded density disc.

FIG. 23, which appears on the same sheet as FIG. 4E, illustrates a disc member 68 of graded density where side 68B is more resilient than side 68C. This causes the softer side 68B to bulge out more than the stiffer side 68C under compressive forces. Side 68B can be orientated to the outside of the skate whereas side 68C can face the inside adjacent the wheels. Side 68C can thus be designed to avoid abrasive contact with the wheels.

Figure 24:
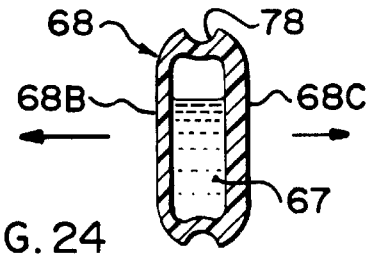
FIG. 24 illustrates an asymmetrically resilient fluid filled disc.

FIG. 24 illustrates a further embodiment where the disc 68 may be filled with a fluid 67. The side walls 68B and 68C are dimensioned to avoid abrasive wheel contact.

Figure 25:
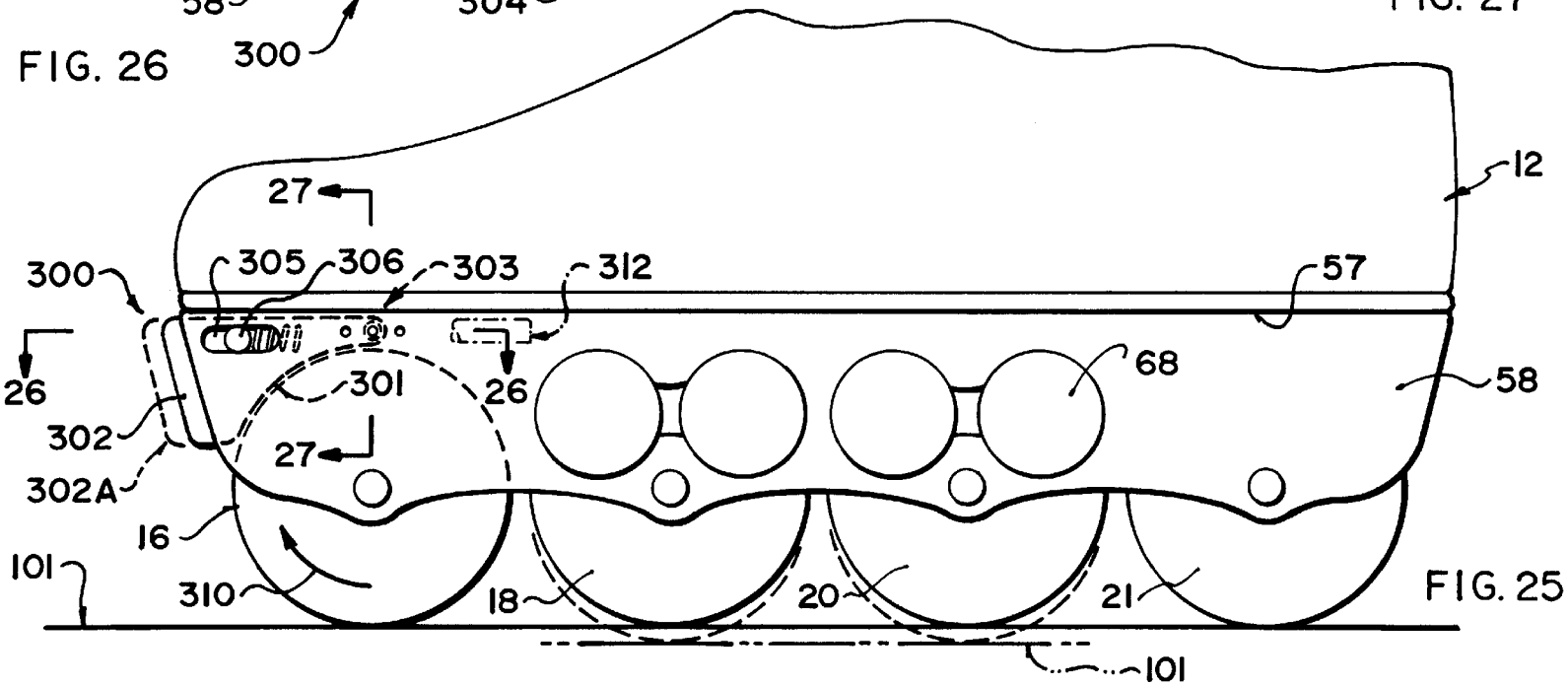
FIG. 25 illustrates a side view of a partially shock-absorbent in line skate with a releasable toe wheel lock.

FIG. 25 illustrates a further embodiment of a shock-absorbent in-line roller skate where only the centre wheels have resilient members over their respective axles. In this embodiment, the initial shock encountered by the first wheel 16 (in forward motion) encountering a bump is dampened by the foot of the skater as the toe pivots upward about the ankle of the skater over the bump. The second and third wheels, 18 and 20, absorb the shock of the bump in turn by displacing or compressing their respective resilient members 68. This allows the toe wheel 16 to recontact the ground surface 101 thereby allowing the toe wheel 16 to be used for directional control, while the following wheels negotiate the bump in turn and absorb shock. The rear wheel 21 absorbs the shock of the bump generally by the upward movement of the skater's heel and corresponding action of the skater's knee. FIG. 25 further shows the ability of the embodiment to adjust relative wheel height. Insertion of larger or stiffer members 68 over the axles of the middle wheels 18 and 20 will tend to downwardly extend the wheels along the dashed lines shown below the wheels 18 and 20 thereby allowing for alternative skating styles as are well known in the in-line skating art, which is progressing constantly.

FIG. 25 also illustrates a removable and replaceable forward wheel brake and lock mechanism 300 which can be used to lock the toe wheel 16 in a wedging manner, between the wheel 16 and the bottom of the sole plate of the boot 12. This locking action can be used to facilitate climbing a slope or negotiating stairs and the like. In operation, the inverted concave saddle shaped surface 301 of the mechanism 300 is tapped rearwardly into frictional engagement with the toe wheel 16 by striking the head 302 of the mechanism against the ground, or against some suitable vertical abutment, such as a curb, post or fence, prior to initiating a climb up a set of stairs or a slope. The rearward position of the mechanism 300 retards or prevents the wheel 16 from rotating in a clockwise direction, as indicated by arrow 310 in FIG. 25. This allows the skater to use the stationary wheel 16 to gain a purchase in climbing. It is not therefore necessary to revert to the current common method of sidestepping uphill or upstairs which is awkward, slow and becomes particularly precarious when negotiating stairs. Increasing clockwise force on the wheel 16 due to the climb will be resisted by automatically increasing wedging action of the lock mechanism 300.

Briefly, returning to FIG. 8B, it will be understood that the bumper 123 illustrated in FIG. 8B may be replaced with a saddle shaped wedge member similar to that shown in FIG.

25. The mechanism is slidably fitted into the socket 121 to lock the front wheel of that embodiment for climbing purposes.

Returning to FIG. 25, the lock mechanism 300 may include a detent keeper 303 which releasably engages detent holes or recesses 304 in the rail 58 in a sequential manner. The keeper 303 ensures that the lock 300 remains engaged as the clockwise rotational force 310 is removed each time a foot is successively raised in the climbing action. Alternative conventional lock mechanisms can be used, for example, a swing lever which applies a locking force to the lock mechanism 300 when rotated to a locked position. The overall concept is to provide a construction which can be moved against the toe wheel 16, or away from it as required.

When the climb is completed, and the skater wishes to free the wedge lock mechanism 300, the skater simply manually grasps the head 302 and pulls it forward to a disengaged detent position as indicated by dashed line 302A in FIG. 25. Advantageously, the skater may also more readily free the front wheel 16 by forcefully striking the wheel 16 forwardly along the ground in a counterclockwise direction, opposite to that of arrow 310 in FIG. 25.

Figure 26:
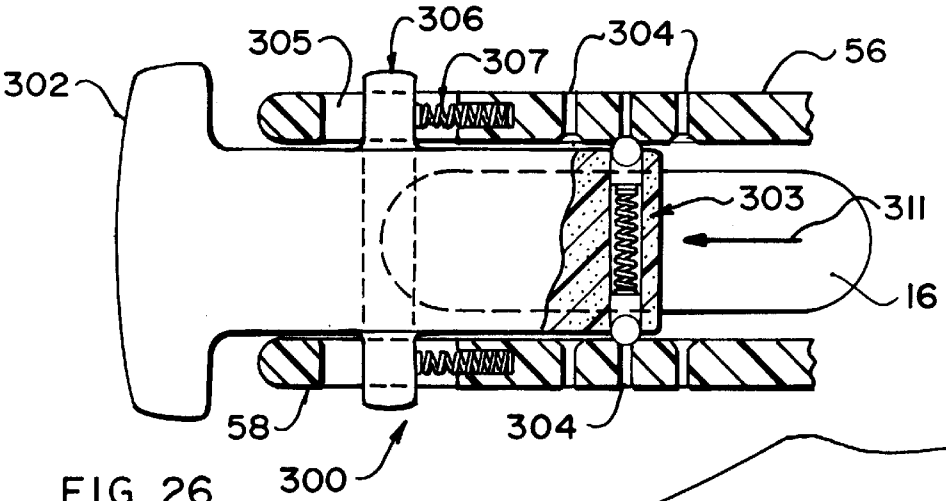
FIG. 26 illustrates a section view taken along section line 26—26 of FIG. 25.

This action may best be seen in FIG. 26 where the counterclockwise force is designated by arrow 311, which is also the direction of the disengaging bias force of springs 307 or 312. The wedge 300 is forced out of the locking detent forwardly of the skate 12 with the pair of biasing springs 307 acting on the ends of retaining guide pin 306 in slots 305 which are formed in rails 56 and 58. This serves to space the under surface 301 away from the circumference of the wheel 16, and permit free wheel rotation once again. Number 312, in FIG. 25, designates an alternative position for a single biasing spring located between the rails 56 and 58 about arrow 311, as shown in FIG. 26. The pin 306 and the detent keeper 303 also prevent the wedge 300 mechanism from resting on the wheel 16 when disengaged.

Figure 27:
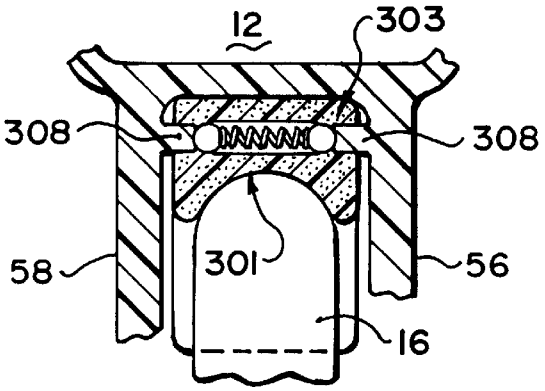
FIG. 27 illustrates a section view taken along section line 27—27 of FIG. 25.

FIG. 27 shows an alternative means of preventing wedge face 301 from riding on the wheel 16 using support flanges 308 which slidably fit in slots in the sides of the wedge member 300. In this case, a click stop detent 303 may engage recesses (not shown) on the inner faces of the flanges 308.

The wheel lock 300 may further be used as a brake while skating backwards, simply by applying the head 302 onto the ground surface 101 with the wheel 16 still in touch with the ground. Progressively greater pressure applied to the head 302 will eventually act to slow the wheel 16 thereby adding to overall braking effectiveness. Such a rearward stopping action is commonly used in the figure ice skating art, and older design roller skates with front and rear paired wheels. The wheel lock 300 enables an in-line wheel skater to simulate maneuvers which are performed by ice skaters.

Figure 30:
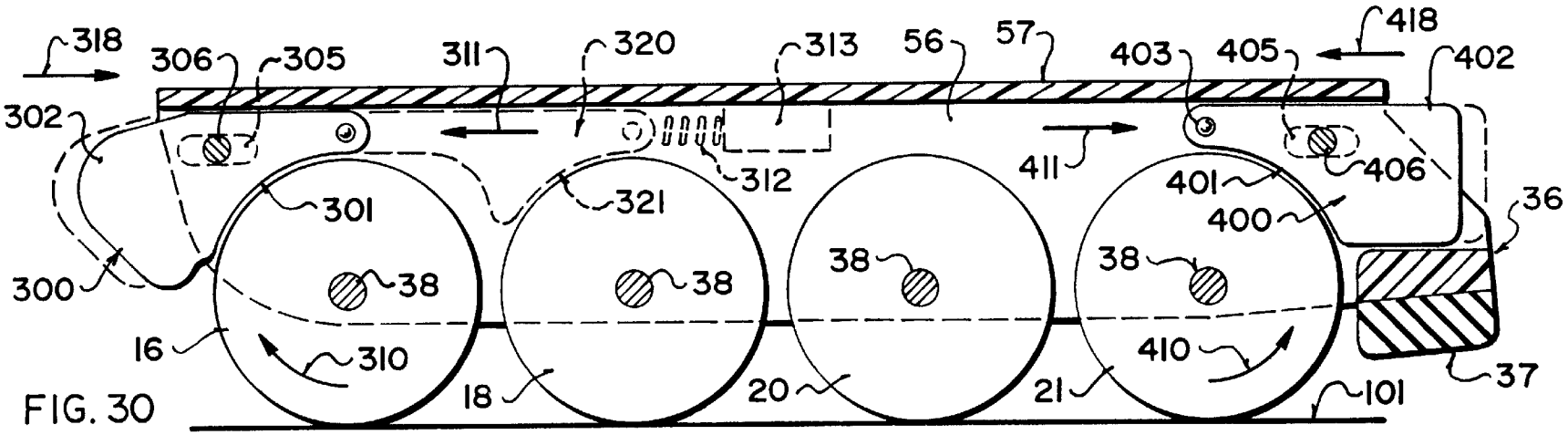
FIG. 30 illustrates a partial section side view of the wheel portion of an in-line skate showing both a front and rear wheel lock.

Preferably each skate will have a toe wheel brake lock mechanism and, although not shown in FIG. 25, may also have a rear brake 36 as seen in other figures, for example, FIG. 30.

Additionally, more than one wheel may be locked simultaneously or sequentially with a series of ganged wedge lock mechanisms (see, for example, FIG. 30). The toe lock wedge may be adapted to any of the foregoing disclosed shock-absorbing in-line skates or shaped to fit most existing conventional in-line skates.

Figure 29:
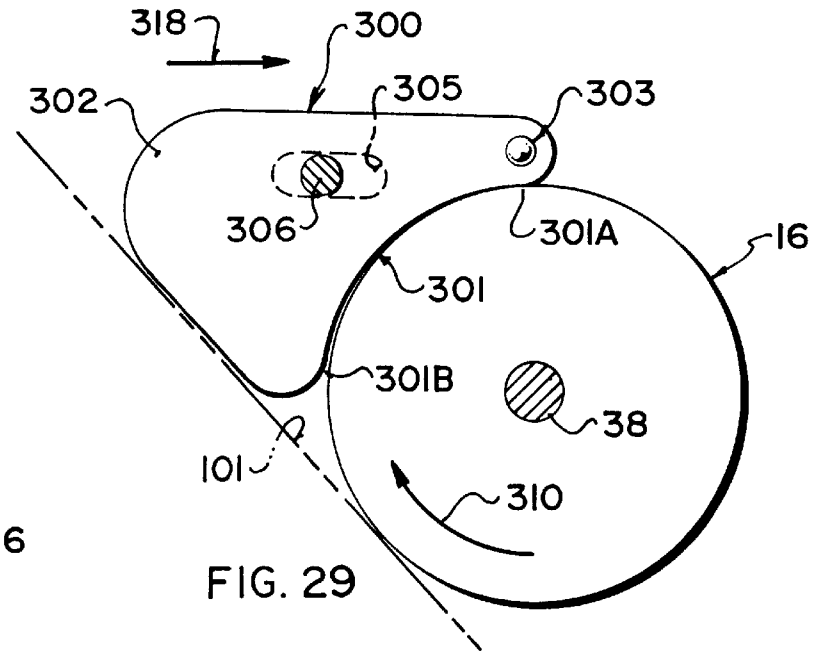
FIG. 29 illustrates a detailed side view of the final phase of progressive braking, just prior to wheel lock, using the toe wheel lock.
Figure 28:
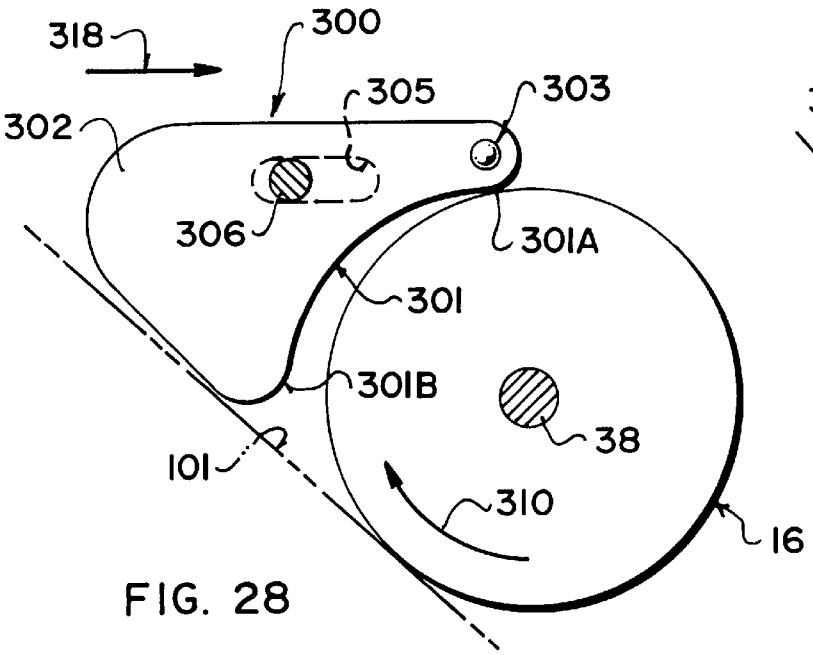
FIG. 28 illustrates a detailed side view of the initial phase of progressive braking using the toe wheel lock.

FIG. 28 illustrates a detailed side view of the initial phase of progressive braking using the toe wheel lock. FIG. 29 illustrates a detailed side view of the final phase of progressive braking, just prior to wheel lock, using the toe wheel lock. Specifically, FIGS. 28 and 29 show the partial sequence in progressive application of wheel retardation toward full wheel lock, where the wheel lock mechanism 300 is used as a brake while skating backwards.

Referring to FIG. 28, it specifically shows the wheel lock mechanism 300 beginning to move rearwardly to contact the surface of the wheel 16 at the end 301A of the face 301. The forward head 302 of the lock mechanism 300 is pushed into contact with the ground surface 101 which forces the lock mechanism 300 to move rearwardly in the direction of the arrow 318. The movement in the direction 318 is opposed by the bias force 311 of the springs 307 or 312 as seen in FIGS. 25, 26, 30 and 31. As the forward head 302 is pushed harder into the ground surface 101 more of the face 301 comes into contact with the wheel surface until the bottom end 301B also engages the wheel. Lock-up of the wheel 16 may, however, occur prior to the surface 301 being fully engaged. Various frictional characteristics of the materials in braking contact may be adjusted to determine the point at which total lock-up occurs. This would further be dependent on anticipated inertial forces.

If FIG. 29, which shows the lock mechanism 300 in a rearward position, is assumed to indicate full lock of the wheel 16, the dashed line 101 may also represent a slope being climbed forwardly or stepping down rearwardly. A rear wheel lock may be added to allow a skater to step down a slope or set of stairs forwardly.

FIG. 30 illustrates a partial section side view of the wheel portion of an in-line skate showing both a front wheel lock 300 and rear wheel lock 402. FIG. 30 represents a side view of an inline skate with only one side flange 56 shown. Web or sole plate 57 is shown in section (boot 12 not shown). Pressure applied to head 302 of lock 300 may also activate a second stopper 320, thereby applying a braking force at the face 321 to the second wheel 18 and may also include a slot 305 and slide pin 306 arrangement similar to wheel lock 300 illustrated in FIGS. 28 and 29. A moveable adjustment device 313 may be used to vary the biasing force 311 of the spring 312.

A rear wheel lock 400 may be applied in a similar manner to forward wheel lock 300 as shown in FIG. 25. The tail end of the lock 402 is pushed forward in the direction of arrow 418 until the curved surface 401 comes into contact with the surface of the wheel 21. It is held in place by a keeper 403 against the release force 411 of a return spring (not shown) similar to spring 312 of front wheel lock 300. Lock 400 prevents the rear wheel 21 from rotating in the direction of arrow 410, which prevents forward rolling motion of the skate. Wheel 20 can be locked as well in a manner similar to extension 320 and wheel 18.

Figure 31:
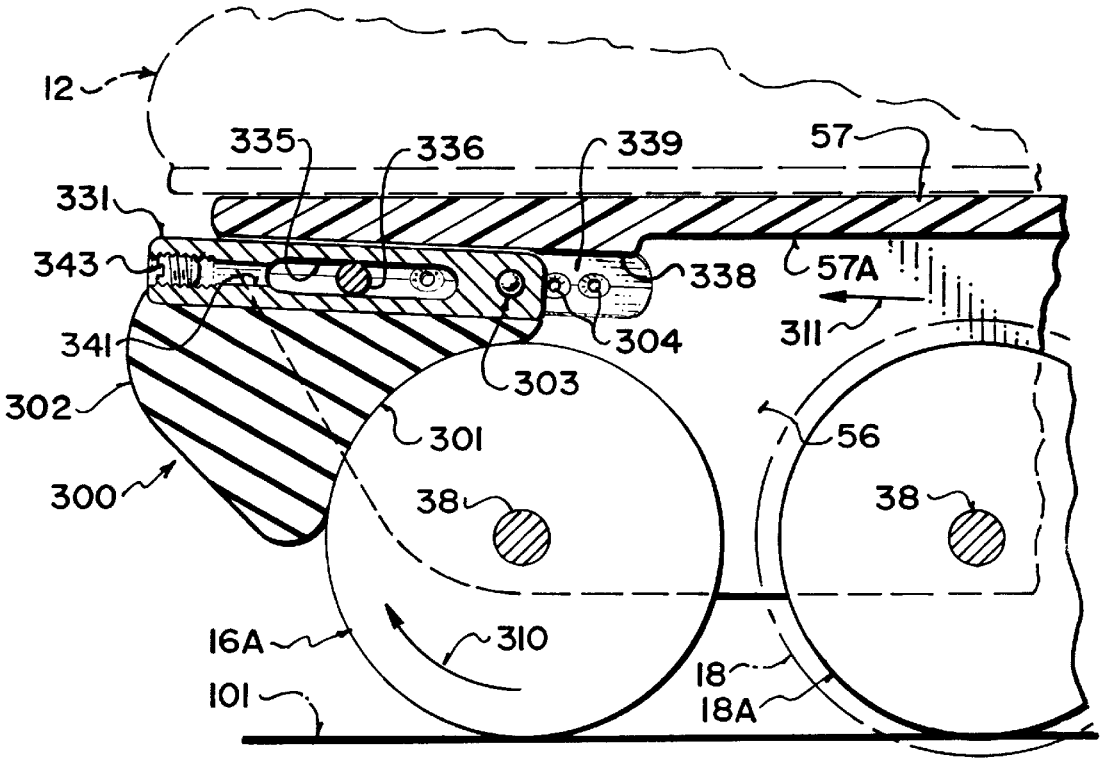
FIG. 31 illustrates a detailed side partial section view of a front toe wheel lock and a method for compensating for wheel or brake wear.

FIG. 31 illustrates a detailed side view of a front toe wheel lock which not only can lock the front wheel but continues to do so by providing a method for compensating for wheel or brake wear. FIG. 31 depicts a partial section with the front toe lock 300 having a head portion 302 and a concave surface 301 which, when the lock 300 is in locking position, contacts the front wheel 16. This contact prevents wheel 16 from rotating about the axle 38 in the direction 310 as mentioned previously. FIG. 31 depicts wheel 16 as worn down in use from an initial diameter shown by dotted line 18 of the second wheel 18 to a diameter shown by solid line 18A (see the second wheel 18 in FIG. 31). When wheel 16 or concave lock surface 301 become worn in use, the contact area should nonetheless remain fairly constant. This can be accomplished by including an inward and downward sloping guide surface 338 to the bottom face 57A of the sole plate 57. Thus, the toe lock 300 tends to move more rearwardly as wear occurs, but the downwardly sloping surface 338 forces the lock 300 downwardly. Thus the braking or locking action remains constant with wear.

In FIG. 31, lateral support pin 336 is mounted to the side rail flanges 56 and 58 which bracket the wheels (as shown previously). The pin 336 together with slot 335 is used to mount the lock 300 and further guides the forward and rearward movement of the toe wheel lock 300. Reference numeral 339 depicts a groove in rail flange 56 which contains counter sunk holes which act as detentes to the keeper 303, as the wheel lock 300 is engaged or disengaged. FIG. 31 also shows a groove 339 or slot 335 which further aids in guiding keeper 303 into click stops 304 and prevent concave lock surface 301 from resting on the wheel 16 after release. A partially threaded bore 341 contains a release spring (not shown) which bears on support pin 336 thereby biasing lock 300 outward and forward in the direction of arrow 311. The force of the release spring may be adjusted by setting the position of set screw 343.

Figure 34:
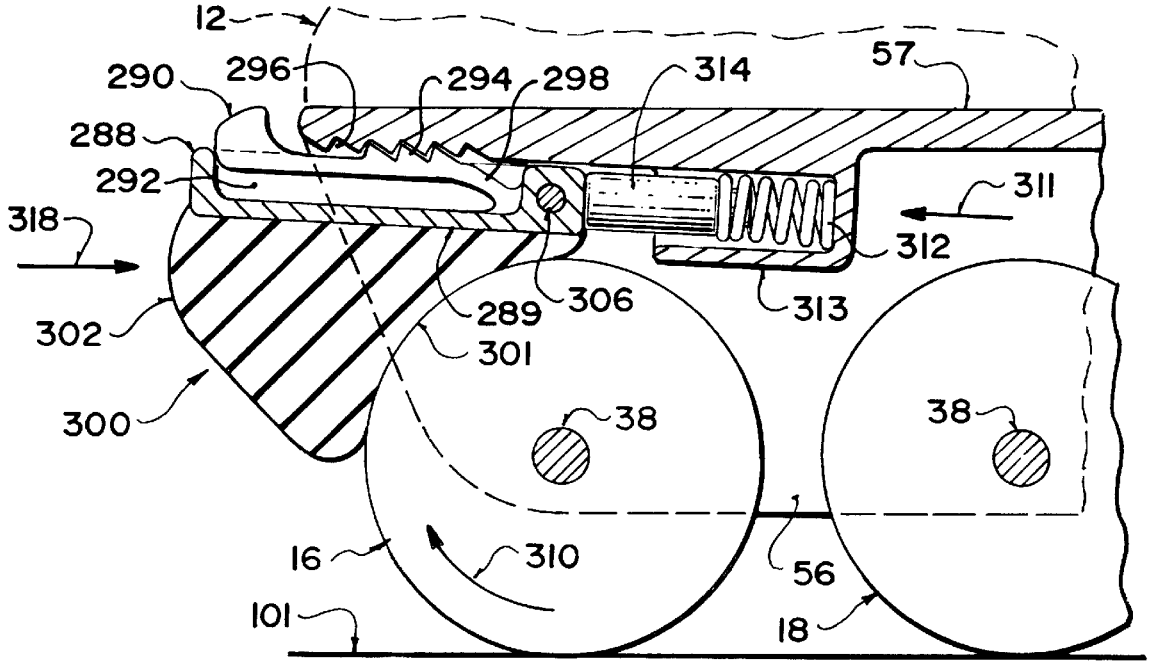
FIG. 34 illustrates a detailed side partial section view of an alternative embodiment of front toe wheel lock, with the lock in a retracted front wheel lock blocking position.

Stopper lock 300 will tend to lower the front wheel 16 in the locked position when used with the shock absorbing in-line skate, as shown in FIG. 34.

This has the further advantage in "unloading" the second and third wheels 18 and 20 in relation to the front locked wheel 16. The fourth wheel 21 may also optionally have a rear lock loading it downwards. This results in both locked wheels 16 and 21 contacting the ground more firmly, thereby allowing the wearer to walk on the skates without having to lock the control wheels.

FIG. 32 illustrates a plan partial section view of the front toe wheel lock similar to that illustrated in FIG. 31. FIG. 32 illustrates by arrow 318 the manner in which lock 300 can be moved rearwardly into a retracted position wheel blocking position by impacting head 302. The lock 300 is formed so that it has two parallel arms 362 which are constructed of resilient material and can be depressed towards one another. The pair of arms 362 can be squeezed or forced together as shown by arrows 361. The space between the two arms 362 can be filled or be formed of a resilient material that is lighter than the material comprising the two arms 362. Such a "filler" material will prevent dirt and debris clogging the action of the lock 300. The natural action of the two arms 362 is to move apart, possibly aided by the inclusion of the between the arms resilient material of the lock 300, which can be made of rubber, elastomer plastic, or the like. Each arm 362 has on the outer surface thereof a respective projection 363. The projections 363 are pointed so that they fit in any one of a series of tapered detente openings 304, formed in a line in respective rails 56 and 58 (see FIG. 33 for further details).

As the head 302 and lock 300 are moved rearwardly (retracted), or forwardly (extended) as the case may be, the pair of projections 363 snap outwardly into the respective pairs of detentes or openings 304. The lock 300 is retained on the skate and slides by pin 336 in groove 335. Three pairs of lock position detentes or openings 304 are shown in FIG. 32. However, more detentes or openings 304 can be provided if required. With the combination of pairs of detentes or openings 304 and the two outwardly facing projections 363 which snap into the respective opposing detentes or openings 304, it is possible to set the lock 300 in any one of a number of forward (extended) or rearward (retracted) positions in order to provide appropriate braking or wheel stopping action, or compensate for wheel and/or stopper wear.

Figure 33:
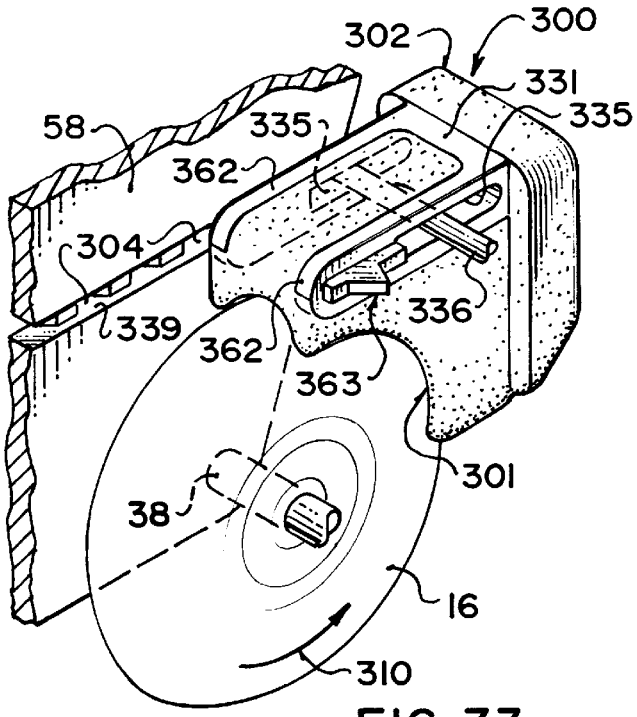
FIG. 33 illustrates an isometric partial section view of the front toe wheel lock illustrated in FIG. 32.

FIG. 33 illustrates an isometric partial section view of the front toe wheel lock illustrated in FIG. 32. FIG. 33 further illustrates the combination of detentes or openings 304, which are formed in groove 339 of side rail 58. A corresponding opposing groove is formed in side rail 56 (not shown) which is on the opposite side of the wheel 16. FIG. 33 also illustrates how toe stopper lock 300 slides rearwardly (retracted) or forwardly (extended) in slot 335 containing pin 336 to any of the positions provided by detentes or openings 304.

FIG. 33 further illustrates the construction of the two arms 362 which carry the respective projections 363. Since the arms 362 are constructed of resilient material, with a resilient filler material between, the two arms 362 can move towards or away from one another, thereby enabling the two projections 363 to snap outwardly into the respective pairs of detentes or openings 304 to provide appropriate wheel 16 braking or locking action, as required.

The front stopper locks 300 as shown in FIG. 28, 29, 30 and 31, and rear lock 400 (see FIG. 30), may be engaged manually or by striking one or both on a suitable surface or by striking the heel of one skate to the toe of an opposing skate, and vice versa, in a sequence that is dependent on the existing slope that is being negotiated. In going down stairs forwardly, the rear lock 400 may be set by tapping the tail portion 402 on the first riser edge. Rear lock 400 may be disengaged in the same manner as the front lock by striking the locked wheel forcefully on the ground to overcome the keeper opposite the locking direction, or by grasping the head 400. A simple lever (not shown) may be attached to the heel and/or toe of the boot to aid in manual engagement or release of the lock(s).

FIG. 34 illustrates a detailed side partial section view (in enlarged view exaggerated for clarity) of an alternative embodiment of front toe wheel lock, with the lock in a retracted front wheel lock blocking position. As seen in FIG. 34, the stopper lock 300 is constructed with a front head 302 and a curved wheel friction face 301 which, when the stopper lock 300 is in a retracted position, as shown in FIG. 34, bears against a portion of the front circumference of the front wheel 16. Front wheel 16, as seen in FIG. 34, and indicated by arrow 310, rotates about axle 38, as previously described in the specification. To push the stopper lock 300 into a retracted position, as illustrated in FIG. 34, the stopper lock 300 is pushed rearwardly by applying a force against head 302, as indicated by directional arrow 318. On the top surface of the head 302, there is positioned a keeper plate 288, which is formed of a relatively hard material compared to the material from which stopper lock 300 is made. The keeper plate 288 should be strong and is typically constructed of metal, or a hard plastic. In contrast, head 302 is formed of a more resilient rubber or plastic-like material, so that maximum friction is achieved between curved face 301 and the front circumference of front wheel 16. Keeper plate 288 is adhesively secured, or fastened by some other suitable means, to the top surface of head 302 as indicated by bonded face 289. Keeper plate 288 is formed so that it has a well 292 therein. The rear portion of keeper plate 288 has a removable mounting pin 306, which rides in slots 305 (not shown) inside rails 56 and 56 discussed previously. A living hinge spring portion 298 biases the lever 291 upwardly. The front top end of lever 291 has formed thereon a release head 290. The top surface of the lever spring 291, aft of the head 290, has formed thereon a plurality of lateral teeth 294, formed with lateral peaks. When the lever spring 291 and release head 290 are in an upper position, as indicated in FIG. 34, lateral teeth 294 fit within a corresponding matching inverted series of lateral grooves 296 which are formed in the front undersurface of sole plate 57. The sole plate 57 is affixed to the underside of the boot 12, which is indicated in dotted lines.

At the rear of keeper plate 288, and head 302, there is positioned a cylindrical plunger 314, and a coil spring 312, both of which fit within socket 313, which is formed in the underside of sole plate 57. The front end of plunger 314 abuts or can be connected to the rear of the keeper plate 288 by pin 306, if required. When the stopper lock 300 is kicked or manually moved to a retracted position, as indicated in FIG. 34, head 302 and keeper plate 288 move rearwardly to a retracted position, and thereby apply a force to plunger 314, which in turn compresses coil spring 312. At that position, the lateral slots 294, by reason of force exerted upwardly by living hinge spring 298, fit in the corresponding series of teeth 296 formed in the underside of sole plate 57. In this position, the lock 300 is in a lock position and the curved friction surface 301 of stopper lock 300 bears against the front circumference of front wheel 16 and applies a braking or locking action on wheel 16. Abutting is preferred.

Figure 35:
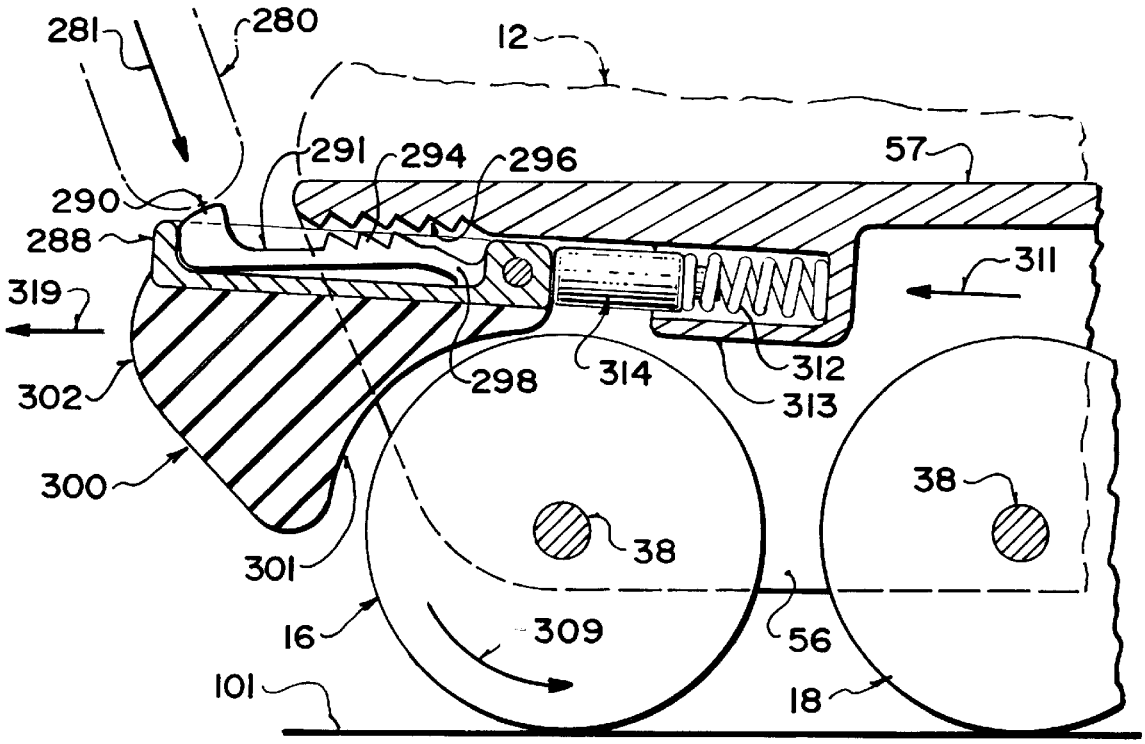
FIG. 35 illustrates a detailed side partial section view of an alternative embodiment of front toe wheel lock, with the lock in an extended front wheel lock non-blocking position.

When the skater wishes to release stopper lock 300, the skater manually or by some other means, such as using the other skate, pushes down on release head 290, as shown in FIG. 35. This forces the living hinge spring 298 downwardly, which in turn lowers the series of lateral teeth 294 so that they no longer contact the series of grooves 296 formed in the bottom surface of the front of sole plate 57. Once this happens, then spring 312, by contact with plunger 314, forces stopper lock 300 to move forwardly to an extended position, as indicated by directional spring 311. In that position, the stopper lock 300 and friction surface 301 no longer contact the front circumference of front wheel 16, but is retained by mounting pin 306 (which rides in slots 305 as explained previously). Wheel 16 is then free to rotate.

The lock 300 can be removed by extracting pin 306, if the skater wishes to lighten the weight of the skate. The lock 300 and pin 306 can be carried in the skater's pocket or by some other means.

FIG. 35 illustrates a detailed side partial section view of the alternative embodiment of front toe wheel lock 300, with the lock 300 in an extended non-wheel locking braking position. As seen in FIG. 35, release head 290 has been moved downwardly as indicated by directional arrow 281, by the wheel of the skater's other skate, or a finger 280 of the skater. As explained above, by pushing release head 290 downwardly, the lateral teeth 294 are moved downwardly so that they no longer contact the series of grooves 296 in the bottom front surface of sole plate 57. Coil spring 312, in socket 313, is no longer in a compressed position, and by bearing against plunger 314, has forced head 302 and stop lock 300 to an extended position. In this position, the friction face 301 of stop lock 300 no longer contacts the front circumference of front wheel 16. In this position, front wheel 16 is free to rotate as indicated by directional arrow 309.

Figure 36:
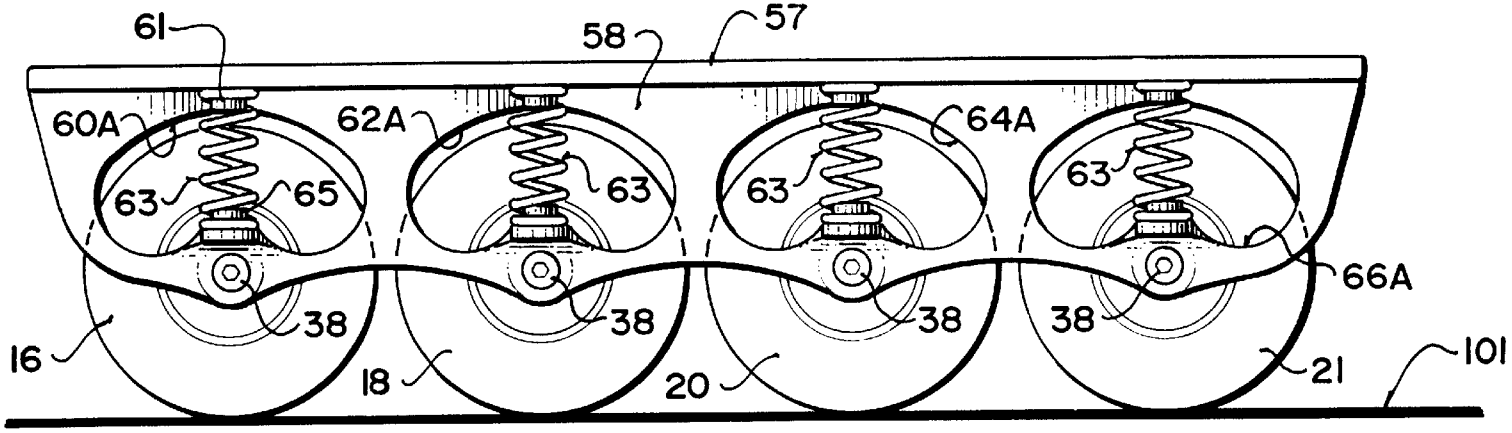
FIG. 36 illustrates a side view of an alternative embodiment of in-line shock absorbing skate with coil springs positioned above the axles of each wheel.

FIG. 36 illustrates a side view of an embodiment of in-line shock absorbing skate with coil springs positioned above the axles of each wheel, and below the sole plate of the boot. As seen in FIG. 36, the side rail 58, which is part of, or secured to the sole plate 57, on the bottom of the boot (not shown but see FIG. 30), has formed therein a series of cavities or openings 60A, 62A, 64A and 66A. These openings 60A, 62A, 64A and 66A correspond in position with wheels 16, 18, 20 and 21. The effect is to provide at the bottoms of each of the openings a series of resilient "bow-action" sections in which the wheels 16, 18, 20 and 21 are respectively rotationally mounted by respective axles 38. A small cylindrical boss 65 is affixed to the top surface of each of these "bow-action" sections. A matching set of small cylindrical bosses 61 are affixed to the bottom surface of sole plate 57, vertically above the respective lower bosses 65. The matching pairs of upper bosses 61 and lower bosses 65 hold between them respective coil springs 63. These springs 63 can compress and in combination with the "bow-action" sections at the bottoms of each of the cavities holding the respective axles 38, enable the wheels 16, 18, 20 and 21 to move vertically upwardly or downwardly to provide an individual suspension system for each wheel. The effect of this independent suspension system enables each wheel to absorb bumps, obstructions and other impediments, and thereby enable the skater to navigate on uneven terrain 101 with ease.

Figure 37:
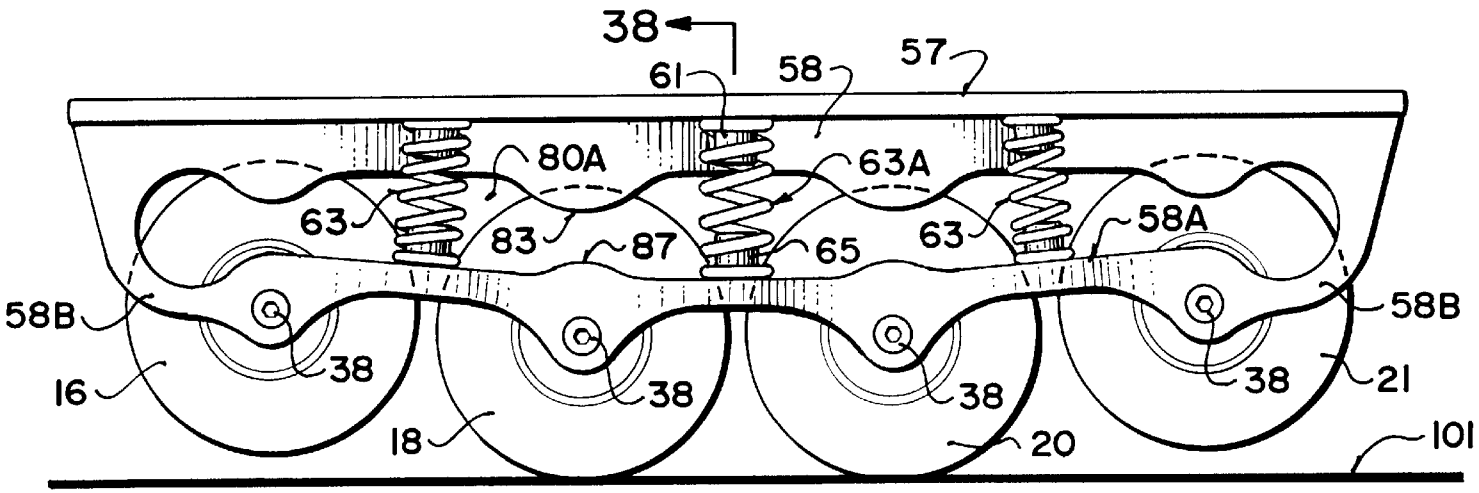
FIG. 37 illustrates a side view of an alternative embodiment of in-line shock absorbing skate with coil springs positioned above and between each wheel.

FIG. 37 illustrates a side view of a further embodiment of in-line shock absorbing skate with coil springs positioned between each wheel. In this embodiment, a longitudinal opening 80A is formed in the side rail 58, thereby forming an upper rail section immediately under the sole plate 57 and a lower rail section 58A. The lower rail 58A section extends between front rail end 58B and rear rail end 58B. Rail 58A is typically formed of a resilient spring-like material so as to provide a "bowing-type action" between the front and rear rail ends 58B. This "bowing action" enables the wheels 16, 18, 20 and 21 to move upwardly or downwardly, and hence more or less individually over bumps and obstructions in the road 101. A trio of vertically disposed coil springs 63 are located at the intersections between the respective wheels 16, 18, 20 and 21. This trio of coil springs 63 are held in place respectively between a trio of upper bosses 61 on the underside of the sole plate and lower cylindrical bosses 65, on the lower rail 58A. The trio of coil springs 63, with coil spring 63A in the middle, in combination with the "bowing-action" of lower rail 58A, impart semi-independent suspension to each of the wheels 16, 18, 20 and 21. Middle 63A can be a stiffer spring, if the skater wants to lower the middle wheels 18 and 20, or if the skater is particularly heavy. In other words, the springs 63 and 63A do not have to be of identical resilient compression force. Curved downward protrusions 83 formed in the upper rail 58, and upwardly extending curved protrusions 87 formed in the top surface of lower rail 58A, create stops which prevent the wheels 16, 18, 20 and 21 from travelling beyond a certain limit and hitting sole plate 57, when bumps and obstructions are encountered on the roadway 101.

Figure 38:
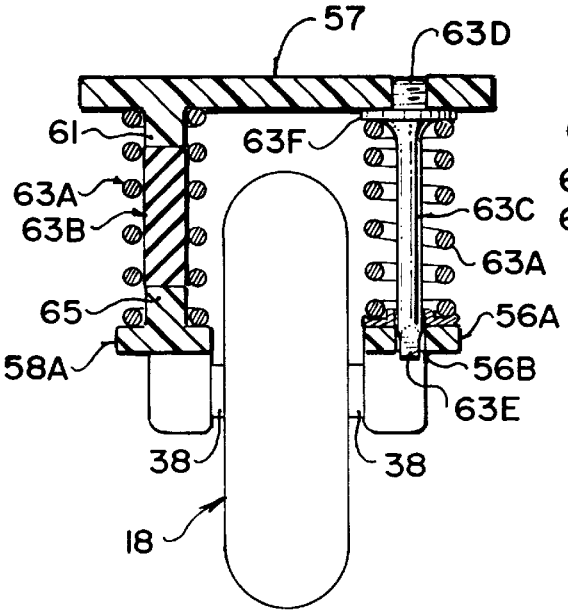
FIG. 38 illustrates a front section view taken along section line 38—38 of FIG. 37, of an embodiment of a shock absorbent in-line roller skate similar to that illustrated in FIGS. 4C and 4D with coil springs substituted for the resilient discs.

FIG. 38 illustrates a section view taken along section line 38—38 of FIG. 37. FIG. 38 illustrates alternative ways of mounting the coil springs 63 and 63A illustrated in FIG. 37. On the left side of FIG. 38, coil spring 63A is held vertically in place by upper boss 61 formed in the underside of sole plate 57 and lower boss 65, formed in the top surface of lower rail 58A. The wheel 18 is journalled for rotation by axle 38, and bearings (not shown) in lower rail 58A. Since coil spring 63A might become clogged with dirt or other debris, when the skater skates through mud, or in the rain, a resilient cylindrical elastomer plug 63B is fitted in the interior of spring 63A. The presence of cylindrical plug 63B prevents dirt and debris from collecting in the interior of coil spring 63A. Plug 63B may be sized to prevent excessive spring extension and thereby provide a damping action to upward and downward wheel movement.

The right hand side of FIG. 38 illustrates an alternative way of mounting spring 63A between the underside of sole plate 57 and the upper surface of lower rail 58A. A vertical post 63C is threaded into sole plate 57 at 63D, and has a washer surface 63F which provides bearing support for spring 63A against the underside of sole plate 57. The lower end of post 63C extends into and through a hole 56B which is formed in lower rail 56A. The lower end of post 63C has a square head formed thereon at 63E. This head 63E enables the post 63C to be threaded into the underside of sole plate 57 at 63D. When coil spring 63A compresses, such as when wheel 18 contacts a bump in the roadway (see 102 in FIG. 39), the rail 56A moves upwardly, thereby compressing spring 63A. In that case, the lower end of post 63C moves downwardly through hole 56B. The purpose of post 63C is to hold spring 63A in vertical position, and also maintain vertical alignment between the spring 63A and axle 38. The diameter of post 63C can be enlarged. A sleeve which bears against post 63C can be included to retard and dampen the movement of post 63C through hole 56B.

Figure 39:
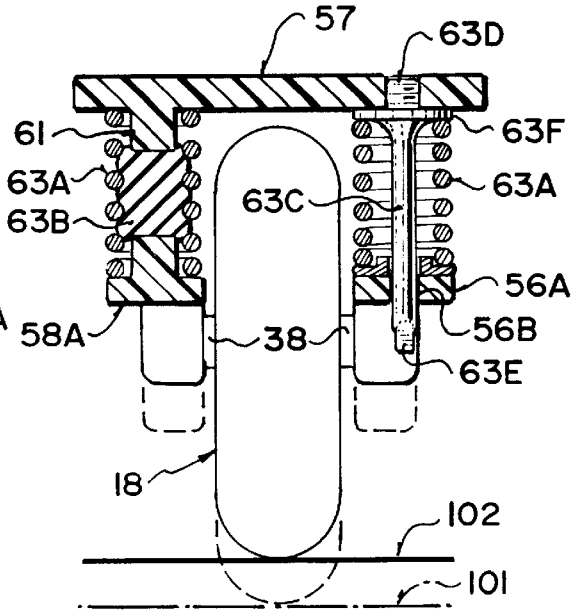
FIG. 39 illustrates a front section view taken along section line 38—38 of FIG. 37, of an embodiment of a shock absorbent in-line roller skate similar to that illustrated in FIGS. 4C and 4D with coil springs substituted for the resilient discs, with the wheel in an upper position with the spring compressed.

FIG. 39 illustrates a section view similar to that shown in FIG. 38, except in FIG. 39, wheel 18 has been forced to move upwardly by a bump 102 in the ground 101, which is denoted by a horizontal dotted line. In the configuration shown at the left in FIG. 39, the vertical cylindrical resilient plug 63B has been compressed, but remains within the interior of compressed coil spring 63A. In the configuration shown at the right of FIG. 39, coil spring 63A has been compressed by the wheel 18 and axle 38 exerting an upward force on lower rail 56A. In this position, the bottom end of vertical post 63C protrudes downwardly through the hole 56B formed in lower rail 56A, with the lower end 63A extending downwardly in an extended position.

The embodiments of in-line shock absorbent skates illustrated in FIGS. 36, 37, 38 and 39 demonstrate how other well known forms of spring-action or resilient devices can be substituted for the resilient discs illustrated in previous figures, such as FIGS. 4, 4A, 4B, 4C, 4D, 4E and 4G, in order to provide a resilient spring-like shock absorbing bowing action to the lower portions of the pair of rails 56 and 58, on either side of the wheels 16, 18, 20 and 21. The springs 63, coupled with a choice of materials to form lower rail 56, assist in providing additional stability to the overall in-line shock absorbent skate.

Figure 40:
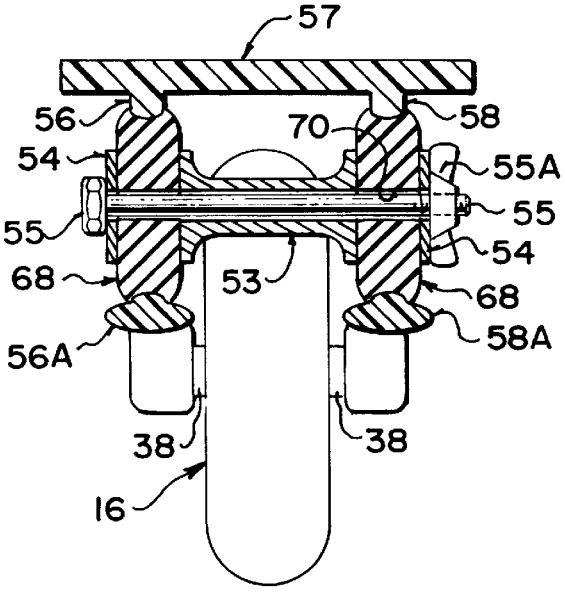
FIG. 40 illustrates a front section view of a pair of resilient discs connected together by a pin for stability and resiliency adjustment.

FIG. 40 illustrates a section view of a pair of resilient discs of the type illustrated and discussed previously, connected together with a bolt to adjust resiliency and enhance lateral stability. As seen in FIG. 40, the pair of facing discs 68, 68 are held together by a bolt 55, washers 54, wing nut 55A, and spacer 53 to provide enhanced dimensional stability in a lateral direction. The bolt 55 passes through washer 54, the left disc 68, central spacer 53, hole 70 of the opposing disc 68, and further washer 54, where its end is connected to a wing nut 55A, or the like. The wing nut 55A is threaded to the end of bolt 55. The skater can tighten bolt 55 using wing nut 55A, which in turn compresses the pair of discs 68 between the respective spacer 53 and washers 54, thereby stiffening the performance of the discs 68, if desired. The bolt 55, washers 54 and spacer 53 should preferably be of lightweight materials, for example, aluminum or plastic, as they are not subject to extreme forces, and overall weight of the in-line skate can be minimized.

Figure 41:
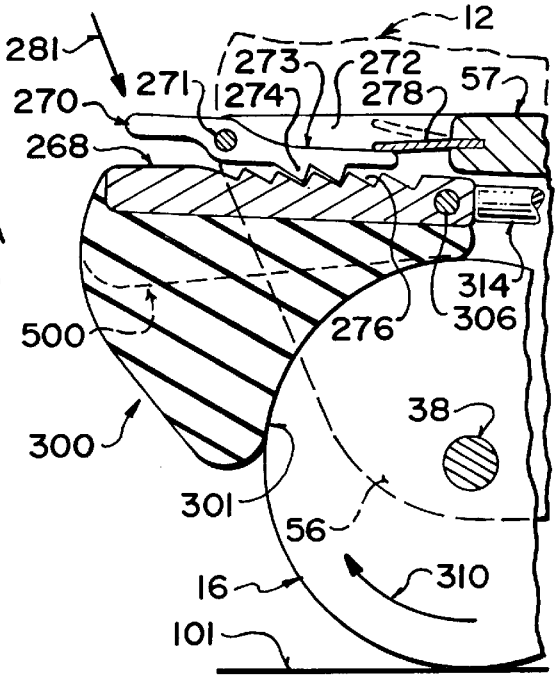
FIG. 41 illustrates a side partial section view of a further alternative embodiment of a front wheel lock with brake release lever.

FIG. 41 illustrates a partial section side view of an embodiment of stopper lock 300, which has a lever type locking mechanism. As seen in FIG. 41, the curved friction face 301 is in a retracted (rearward) position and frictionally engages with the front circumference of front wheel 16. Wheel 16 is rotationally mounted by axle 38 in the lower portion of side rail 56, which is indicated by dotted lines. The top surface of stopper lock 300 has a keeper plate 268 bonded thereon. This keeper plate 268, as explained previously, is formed of a harder material than the material from which the main body of stopper lock 300 is formed. The top surface of keeper plate 268 has formed thereon lateral groove teeth 276. The rear portion of keeper plate 268 abuts cylindrical plunger 314. Plunger 314 bears against a coil spring 312 as discussed previously in relation to FIGS. 34 and 35.

Pivotally mounted above keeper plate 268 is a lever 273, which pivots about lateral lever pivot pin 271. The head 270 of lever 273 can be depressed downwardly by exerting a downward force thereon as indicated by directional arrow 281. A series of lateral teeth 274 are formed on the rear underside of lever 273. When a downward force as indicated by arrow 281 is exerted downwardly on head 270, lever 273 pivots and the rear end thereof is forced upwardly against leaf spring 278, so that one end of the spring 278 moves upwardly as indicated by dotted lines. Lever 273 is pivotally secured to the front end of sole plate 57, on the underside of boot 12 (indicated by dotted lines) between side rails 56, 58, in a recess in the underside of the sole plate 57, and held in place by lateral lever pivot pin 271.

The stopper lock 300 is forced into a retracted position so that friction face 301 bears against the front circumference of wheel 16 and thereby prevents it from rotating. The retracted position can be achieved by forcing the lock 300 rearwardly to a retracted position by either kicking the front face of stopper lock 300, or forcing stopper lock 300 rearwardly by some other manner. Then, to release stopper lock 300, in order to enable wheel 16 to rotate once again, the skater merely presses downwardly on lever release head 270, which disengages teeth 274 from the grooves 276 formed in the top surface of the keeper plate 268. The coil spring (not shown in FIG. 41, but which can be seen in FIGS. 34 and 35) then forces stopper lock 300 forwardly to an extended unlocked position. The lever release head 270 can be coloured with a colour different from the remainder of stopper lock 300, including keeper plate 268, in order to enable the skater to readily locate lever release head 270 from a height and be able to depress it downwardly by either a finger, or a wheel of the other skate, or some other suitable object. Indicia indicating stopper wear can be incorporated in the lock 300. Beyond a given wear indication, the stopper should be replaced.

Lock 300 can be detached from the skate 12 by removing pin 306, and carried in the skater's pocket. This makes the skate 12 somewhat lighter. Then when the skater requires a wheel locking action, the skater simply puts lock 300 and pin 306 back in place. It will be understood that some other suitable way of detachably installing lock 300 in position can be used. This would include pull pins or bayonet-style buckles such as those used on belts and straps of back packs. Any other suitable, conventional, easy to use detachable buckling or locking mechanisms can be employed, as required. FIG. 41 also shows in dotted line alternative head 500, how the shape of lock 300 and friction face 301 can be changed to have a more wedge-like configuration, if a narrower different shape of lock 300 is required. Wedge 500 simply wedges the top of wheel 16, rather than meeting with a portion of wheel 16. A smaller head 500 is easier to carry. It can be ganged as shown in FIG. 30 if more wheels are to be blocked.

Although the overall weight appears to increase with some combinations of resilient disc densities, and this may be of concern, this factor may be offset by the incorporation of lighter weight ground wheels, and lightweight parts. Resilient shock-absorbing in-line skates are of great benefit in long downhill runs where comfort is desirable and lack of control of paramount concern. On relatively slow level surfaces, lighter weight replaceable resilient elements may be used or the replaceable elements removed entirely dependent according to skater weight and boot rail resiliency ratios. At some ratios, the removal of a number of the resilient discs may result in the rails sagging and the wheels of the skate contacting the bottom of the boot sole plate, particularly where wheel travel limit stops are not provided. This situation can be of advantage, however, in that it would allow the skater to walk if so desired. Spare resilient members may be carried by the skater to alter the behavioral characteristics of the skate in response to varying road conditions. These shock-absorbing in-line skates may be designed for country road or limited cross country applications.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An in-line roller skate comprising:

(a) a boot with a heel and toe adapted to receive a foot of a skater;

(b) a first wheel supporting rail secured to an underside of the boot and extending from the heel to the toe, the first rail having a first cavity therein between the heel and the toe to thereby form upper and lower first rail regions above and below the first cavity, the first cavity removably receiving a first resilient shock absorbing mechanism and removably securing the resilient shock absorber in place;

(c) a second wheel supporting rail secured to an underside of the boot and extending from the heel to the toe the second wheel supporting rail being proximate and generally parallel to the first rail, and spaced from the first rail, the second rail having a second cavity therein between the heel and the toe to thereby form upper and lower rail regions above and below the second cavity, the second cavity removably receiving a second resilient shock absorbing mechanism and removably securing the resilient shock absorber in place;

(d) a plurality of wheels mounted in aligned series between the first and second rails, the wheels being respectively connected to the first and second rails by a respective series of lateral axles and bearings, first and second ends of the axles being located in the first and second cavities respectively;

(e) at least one first resilient shock absorbing mechanism removably located in the first cavity, between the upper and lower regions of the first rail, the lower end of the first resilient shock absorbing mechanism contacting the first end of the axle in the first cavity and resiliently enabling the first end of the axle to move upwardly in the first cavity when an upward force is applied to the wheel;

(f) at least one second resilient shock absorbing mechanism removably located in the second cavity between the upper and lower regions of the second rail, the lower end of the second resilient shock absorbing mechanism contacting the second end of the axle in the second cavity and resiliently enabling the second end of the axle to move upwardly in the second cavity when an upward force is applied to the wheel, the first and second resilient shock absorbing mechanisms enabling the plurality of wheels to move under force individually or in combination upwardly or downwardly relative to the upper regions of the first and second rails and the boot;

(g) a first member removably secured to the lower region of the first rail for removably holding the first shock absorbing mechanism in place in the first cavity and when removed enabling the first shock absorbing mechanism to be removed; and (h) a second member removably secured to the lower region of the second rail for removably holding the second shock absorbing mechanism in place in the second cavity and when removed enabling the second shock absorbing mechanism to be removed.

2. A roller skate as claimed in claim 1 wherein there are a pair of respective resilient shock absorbing mechanisms for each wheel, axle and bearing and the resilient shock absorbing means are mounted in respective elongated vertical cavities formed in the first and second rails.

3. A roller skate as claimed in claim 1 wherein the lower regions of the first and second wheel supporting rail have lateral stabilizer webs extending between them.

4. A roller skate as claimed in claim 1 wherein the respective resilient shock absorbing mechanisms are located proximate to openings in the first and second rails and the openings enable the wheels and the lower regions of the first and second rails to move upwardly when subjected to a force.

5. A roller skate as claimed in claim 1 wherein there are four wheels and at least four first cavities are formed in the first rail and at least four second cavities are formed in the second rail, the first and second cavities coinciding with the positions of the axles of the four wheels respectively.

6. A roller skate as claimed in claim 5 wherein the resilient shock absorbing means are resilient elastomeric plugs that are held in place in relation to the axle means and the rail means by connector means.

7. A roller skate as claimed in claim 1 wherein the first and second resilient shock absorbing mechanism are coil springs.

8. A roller skate as claimed in claim 5 wherein the first and second shock absorbing means are coil springs.

9. An in-line roller skate comprising:

(a) a boot adapted to receive a foot of a skater;

(b) a wheel mounting mechanism secured to the underside of the boot, longitudinal with the boot, and having therein an elongated longitudinal wheel receiving opening which defines a first longitudinal side rail and a second longitudinal side rail parallel with and spaced from the first side rail with at least one first vertical cavity formed in the first side rail, and at least one second vertical cavity formed in the second side rail of the wheel mounting mechanism;

(c) a plurality of wheels rotatably mounted in series within the wheel receiving opening the ends of the axles of the wheels being located respectively in the first and second cavities;

(d) a first removable resilient compression force absorbing mechanism fitted in or proximate to the first cavity in the wheel mounting mechanism and bearing on an axle of the wheel;

(e) a second removable resilient compression force absorbing mechanism fitted in or proximate to the second cavity of the wheel mounting mechanism and bearing on an axle of the wheel, thereby enabling the wheels to deflect vertically upwardly into the interior of the wheel receiving opening when subjected to a force;

(g) a first member removably secured to the first side rail for holding the first shock absorbing mechanism in place and when removed enabling the first shock absorbing mechanism to be removed; and (h) a second member removably secured to the second side rail for holding the second shock absorbing mechanism in place and when removed enabling the second shock absorbing mechanism to be removed.

10. A roller skate as claimed in claim 9 wherein the first resilient compression force absorbing mechanism comprises a plurality of first resilient compression force absorbers, and the second resilient compression force absorbing mechanism comprises a plurality of second resilient compression force absorbers, which in combination enable the plurality of wheels to deflect into the interior of the wheel receiving opening.

11. A roller skate as claimed in claim 9 wherein the resilient compression receiving means are formed of resilient elastomer.

12. A roller skate as claimed in claim 9 wherein the first and second rails of the wheel mounting means have formed therein at least one respective opening, each opening receiving at least one resilient disc-like compression absorbing means.

13. A roller skate as claimed in claim 12 wherein the disc-like compression absorbing means are connected together in pairs.

14. A roller skate as claimed in claim 9 wherein the first and second resilient compression force absorbing mechanisms are coil springs.

15. A roller skate as claimed in claim 10 wherein the first and second resilient compression force absorbing mechanisms are coil springs.

16. A roller skate as claimed in claim 9 wherein the wheels have rotatable bearings therein and the axles are secured to the first and second side rails of the wheel supporting mechanism at the base of the first and second cavities.

17. A roller skate as claimed in claim 16 wherein the first and second resilient compression absorbing mechanisms are coil springs which are detachably fitted above the axles of the wheels which are rotatably mounted in the wheel mounting mechanism, and the lower ends of the coil springs bear upon the axles.

18. A roller skate as claimed in claim 1 including a releasable wheel stop located between the underside of a toe of the boot and the top of a front wheel of the plurality of wheels, said wheel stop being capable of being reciprocally moved from a forward extended non-wheel locking position, to a rearward recessed wheel locking position.

19. A roller skate as claimed in claim 1 including a releasable wheel stop located between the underside of a heel of the boot and the top of the rear wheel of the plurality of wheels, said wheel stop being capable of being reciprocally moved from a forward recessed wheel locking position, to a rearward extended non-wheel locking position.

20. A roller skate as claimed in claim 18 wherein the wheel stop includes releasable detente means which holds the wheel stop in a predetermined position.

21. An in-line roller skate comprising:

(a) a boot adapted to receive a foot of a skater;

(b) a wheel mounting device secured to the underside of the boot, longitudinal with the boot, and having an elongated longitudinal wheel receiving opening therein, to form on either side first and second rails;

(c) a plurality of wheels rotatably mounted on axles and bearings in series within the wheel receiving opening in longitudinal alignment with one another;

(d) a plurality of resilient shock absorbing mechanisms located above the respective axles and bearings in cavities in the first and second rails to enable the respective wheels to move under force vertically upwardly or downwardly relative to the first and second rails; and (e) a releasable wheel rotation stop located between the underside of the boot and a wheel of the plurality of wheels, said wheel rotation stop being moveable so that it can impinge against the wheel to retard rotation of the wheel;

(g) a first removable member secured to the first rail for holding one of the shock absorbing mechanisms in place and when removed enabling the shock absorbing mechanism to be removed; and (h) a second removable member secured to the second rail for holding one of the shock absorbing mechanisms in place and when removed enabling the shock absorbing mechanism to be removed.

22. A roller skate as claimed in claim 21 wherein the wheel stop is moveable between a first position wherein the stop is free of the forward wheel and permits the forward wheel to rotate and a second position wherein the stop abuts the forward wheel and prevents rotation of the forward wheel.

23. A roller skate as claimed in claim 22 wherein the wheel stop has a releasable lock which enables the stop to be locked in a first or second position.

24. A roller skate as claimed in claim 21 including a second wheel stop which is located between the underside of a heel of the boot and above a rear wheel of the plurality of wheels.

25. A roller skate as claimed in claim 21 wherein the wheel rotation stop is slidably mounted on the underside of the toe, the stop has a curved friction surface which faces the adjacent wheel, and the stop is movable horizontally between a first extended position whereby the curved surface of the wheel rotation stop does not impinge on a front wheel, and a second recessed position whereby the curved surface of the wheel rotation stop impinges on the front wheel and thereby stops rotation of the front wheel.

26. A roller skate as claimed in claim 25 wherein the wheel rotation stop slidably moves in respective slots in the first and second rails and the stop has lateral projections on each side thereof, the projections releasably fitting in respective detente openings formed in the first and second rails of the wheel mounting device, thereby enabling the wheel stop to reciprocally move from a first extended position to a second recessed position.

27. A roller skate as claimed in claim 21 wherein the wheel rotation stop has a releasable lock which enables the stop to be releasably locked in a first wheel-free position or releasably locked in a second wheel lock position whereby the wheel is prevented from rotating.

28. A roller skate as claimed in claim 21, wherein the plurality of wheels are mounted in tandem in a line between the first and second rail means and have therein a plurality of resilient spokes which enable the circumferences of the respective wheels to depress relative to the axle means when subjected to a load, and thereby absorb shock.

29. A rail and wheel apparatus for affixing to the underside of an in-line roller skate boot comprising:

(a) a first wheel supporting rail securable to an underside of the boot and extending from the heel to the toe of the boot, the first rail having a first cavity therein between heel and toe ends of the first rail, the first cavity receiving a first resilient shock absorbing mechanism and removably securing the upper end of the resilient shock absorbing mechanism in place in the first rail and the lower end of the resilient shock absorbing mechanism on an axle of a wheel;

(b) a second wheel supporting rail securable to an underside of the boot, and extending from the heel to the toe of the boot proximate and generally parallel to the first rail, and spaced from the first rail, the second rail having a second cavity therein between heel and toe ends of the second rail, the second cavity receiving a second resilient shock absorbing mechanism and removably securing the upper end of the resilient shock absorbing mechanism in place in the second rail and the lower end of the resilient shock absorbing mechanism on an axle of a wheel;

(c) a plurality of wheels mounted in a series between the first and second rails, the wheels being respectively connected to the first and second rails by a respective series of lateral axles and bearings, the first and second ends of the axles being located in the first and second cavities respectively;

(d) a first resilient shock absorbing mechanism located in the first cavity, the lower end of the first shock absorbing mechanism contacting the first end of the axle of the wheel in the first cavity and enabling the first end of the axle to move upwardly in the cavity when an upward force is applied to the wheel;

(e) a second resilient shock absorbing mechanism located in the second cavity, the lower end of the second shock absorbing mechanism contacting the second end of the axle of the wheel in the second cavity and enabling the second end of the axle to move upwardly in the cavity when an upward force is applied to the wheel, the first and second resilient shock absorbing mechanisms enabling the plurality of wheels to move under force individually or in combination upwardly or downwardly relative to the upper regions of the first and second rails and the boot;

(f) a first removable member secured to the first rail for holding the first shock absorbing mechanism in place and when removed enabling the first shock absorbing mechanism to be removed; and (g) a second removable member secured to the second rail for holding the second shock absorbing mechanism in place and when removed enabling the second shock absorbing mechanism to be removed.

30. A rail and wheel system as claimed in claim 29, wherein the first and second shock absorbing mechanisms are springs.

31. A rail and wheel system as claimed in claim 29, wherein the plurality of wheels mounted in series between the first and second rails have therein a plurality of resilient spokes which enable the circumferences of the respective wheels to depress relative to the axles when subjected to a load, and thereby absorb shock.

* * * * *